US009508330B2

(12) United States Patent
Buskies et al.

(10) Patent No.: US 9,508,330 B2
(45) **Date of Patent: *Nov. 29, 2016**

(54) SYSTEM AND METHOD FOR GENERATING A RHYTHMIC ACCOMPANIMENT FOR A MUSICAL PERFORMANCE

(71) Applicant: APPLE INC., Cupertino, CA (US)

(72) Inventors: Christoph Buskies, Hamburg (DE); Matthias Gros, Hamburg (DE); Alexander H. Little, Woodside, CA (US); Thomas Sauer, Pinneberg (DE); Oliver Ludecke, Rellingen (DE); Tobias Bade, Rellingen (DE)

(73) Assignee: Apple Inc., Cupertino, CA (US)

( * ) Notice: Subject to any disclaimer, the term of this patent is extended or adjusted under 35 U.S.C. 154(b) by 83 days.

This patent is subject to a terminal disclaimer.

(21) Appl. No.: 14/641,015

(22) Filed: Mar. 6, 2015

(65) Prior Publication Data

US 2015/0221297 A1 Aug. 6, 2015

Related U.S. Application Data

(63) Continuation of application No. 13/941,486, filed on Jul. 13, 2013, now Pat. No. 9,012,754.

(51) Int. Cl.
*G10H 7/00* (2006.01)
*G10H 1/40* (2006.01)
(Continued)

(52) U.S. Cl.
CPC ..... *G10H 1/40* (2013.01); *G10H 1/0066* (2013.01); *G10H 1/42* (2013.01);
(Continued)

(58) Field of Classification Search
CPC ..... G10H 2210/086; G10H 2210/076; G10H 2220/015; G10H 1/40; G10H 1/42; G10H 1/0066; G10H 2210/341; G10H 2210/051; G10H 2210/101; G10H 2220/106; G10H 2220/126; G10H 2240/081; G10H 2240/145; G10H 2250/641
USPC ..... 84/611, 635
See application file for complete search history.

(56) References Cited

U.S. PATENT DOCUMENTS 5,484,957 A 1/1996 Aoki et al.
5,654,517 A 8/1997 Miyamoto
(Continued)

FOREIGN PATENT DOCUMENTS

EP 2 515 296 A1 10/2012

OTHER PUBLICATIONS

International Search Report and Written Opinion for International PCT Application No. PCT/US2014/042689, mailed Sep. 29, 2014, 12 pages.
(Continued)

*Primary Examiner* — Jeffrey Donels
(74) *Attorney, Agent, or Firm* — Kilpatrick Townsend & Stockton LLP

(57) ABSTRACT

Embodiments of the invention include storing musical elements in a database and processing performance data, where the musical elements including a plurality of reference accent pattern data and a plurality of reference system pattern data. Processing performance data can include receiving input data corresponding to a musical performance, determining an accent pattern for the musical performance, matching the accent pattern data to one or more reference accent pattern data in the database, and selecting one of the matching reference accent patterns. Processing performance data further includes receiving input corresponding to a selection of a musical style, one or more musical performance parameters, and generating a musical accompaniment based on the processed performance data, the selected musical style, and the selected one or more musical performance.

21 Claims, 22 Drawing Sheets

(51) Int. Cl.
*G10H 1/42* (2006.01)
*G10H 1/00* (2006.01)

(52) U.S. Cl.
CPC . *G10H 2210/051* (2013.01); *G10H 2210/101* (2013.01); *G10H 2210/341* (2013.01); *G10H 2220/106* (2013.01); *G10H 2220/126* (2013.01); *G10H 2240/081* (2013.01); *G10H 2240/145* (2013.01); *G10H 2250/641* (2013.01)

(56) References Cited

U.S. PATENT DOCUMENTS

| | | | | | |
|---|---|---|---|---|---|
| 5,859,380 | A | * | 1/1999 | Anada | 84/611 |
| 5,962,802 | A | * | 10/1999 | Iizuka | 84/609 |
| 6,011,212 | A | * | 1/2000 | Rigopulos et al. | 84/667 |
| 6,162,982 | A | * | 12/2000 | Aoki | 84/611 |
| 6,486,390 | B2 | * | 11/2002 | Aoki et al. | 84/611 |
| 6,703,549 | B1 | | 3/2004 | Nishimoto et al. | |
| 6,945,784 | B2 | * | 9/2005 | Paquette et al. | 434/307 A |
| 9,012,754 | B2 | | 4/2015 | Buskies et al. | |
| 2004/0159214 | A1 | | 8/2004 | Tsuge et al. | |
| 2012/0192701 | A1 | | 8/2012 | Watanabe et al. | |
| 2015/0013527 | A1 | | 1/2015 | Buskies et al. | |

OTHER PUBLICATIONS

Anonymous, "Feel-Good Factor, Giving Your MIDI Tracks a Live Fee: Part 1", SOS, Jul. 1, 2011; http:jjwww.soundonsound.comjsosjjul01/articlesjgrove1.asp, downloaded on Sep. 12, 2014, 5 pages.

Anonymous, "Feel-Good Factor, Giving Your MIDI Tracks a Live Fee: Part 2", SOS, Aug. 1, 2011; http://www.soundonsound.comjsosjaug01/articlesjgroove2.asp, downloaded on Sep. 12, 2014, 5 pages.

Notice of Allowance for U.S. Appl. No. 13/941,486, mailed Dec. 9, 2014, 7 pages.

Ex Parte Quayle Action for U.S. Appl. No. 13/941,486, mailed Oct. 8, 2014, 7 pages.

International Report on Patentability for International PCT Application No. PCT/US2014/042689, mailed Jan. 28, 2016, 12 pages.

Examination Report for Great Britain Application No. 152598.0, mailed Feb. 12, 2016, 3 pages.

Examination Report for Great Britain Application No. 152598.0, mailed Jun. 15, 2016, 3 pages.

* cited by examiner

310
Sample Accompaniment
1
2
3
4
302
302
304 Bass Drum
305 Snare
306 Hi Hat
307 Cymbal 320
Accents
Bass Drum
Snare 330
System
Hi Hat 340
Fill #1
4
Bass Drum
Snare
Hi Hat
Cymbal
Sm Tom
Mid Tom
308
309

342
Fill #2
4

344
Fill #3
4

500

800

850

880

SYSTEM AND METHOD FOR GENERATING A RHYTHMIC ACCOMPANIMENT FOR A MUSICAL PERFORMANCE

CROSS-REFERENCES TO RELATED APPLICATIONS

This application claims priority under 35 U.S.C. §120 as a continuation of U.S. application Ser. No. 13/941,486, filed Jul. 13, 2013, which is herein incorporated by reference in its entirety for all purposes.

The following non-provisional U.S. patent applications (including the parent application listed above) were filed concurrently, and the entire disclosure of the other applications are incorporated by reference into this application in their entirety for all purposes:

application Ser. No. 13/941,487, filed Jul. 13, 2013, and titled "System and Method for Modifying Musical Data."

application Ser. No. 13/941,488, filed Jul. 13, 2013, and titled "System and Method for Determining an Accent Pattern for a Musical Performance."

BACKGROUND

Drum machines and sequencers have long been used to generate rhythmic accompaniments for musicians lacking access to a full band, drumming proficiency, or a convenient means of recording drumming performances. Musicians typically use prerecorded ("canned") drum loops to create drum tracks. Drum sequencing with canned loops can be easy to create, however they are extremely limited in their scope of application. For example, drum loops at 100 beats-per-minute (BPM) may not be useable at 130 BPM without significant sample editing and waveform manipulation (e.g., slicing, cutting, etc.). Furthermore, canned loops tend to sound formulaic and repetitive. In short, conventional methods of creating drum tracks using a drum machine or sequencer is typically cumbersome and tedious, with few customizable options that yield unconvincing artificial performances.

DETAILED DESCRIPTION

Figure 1:
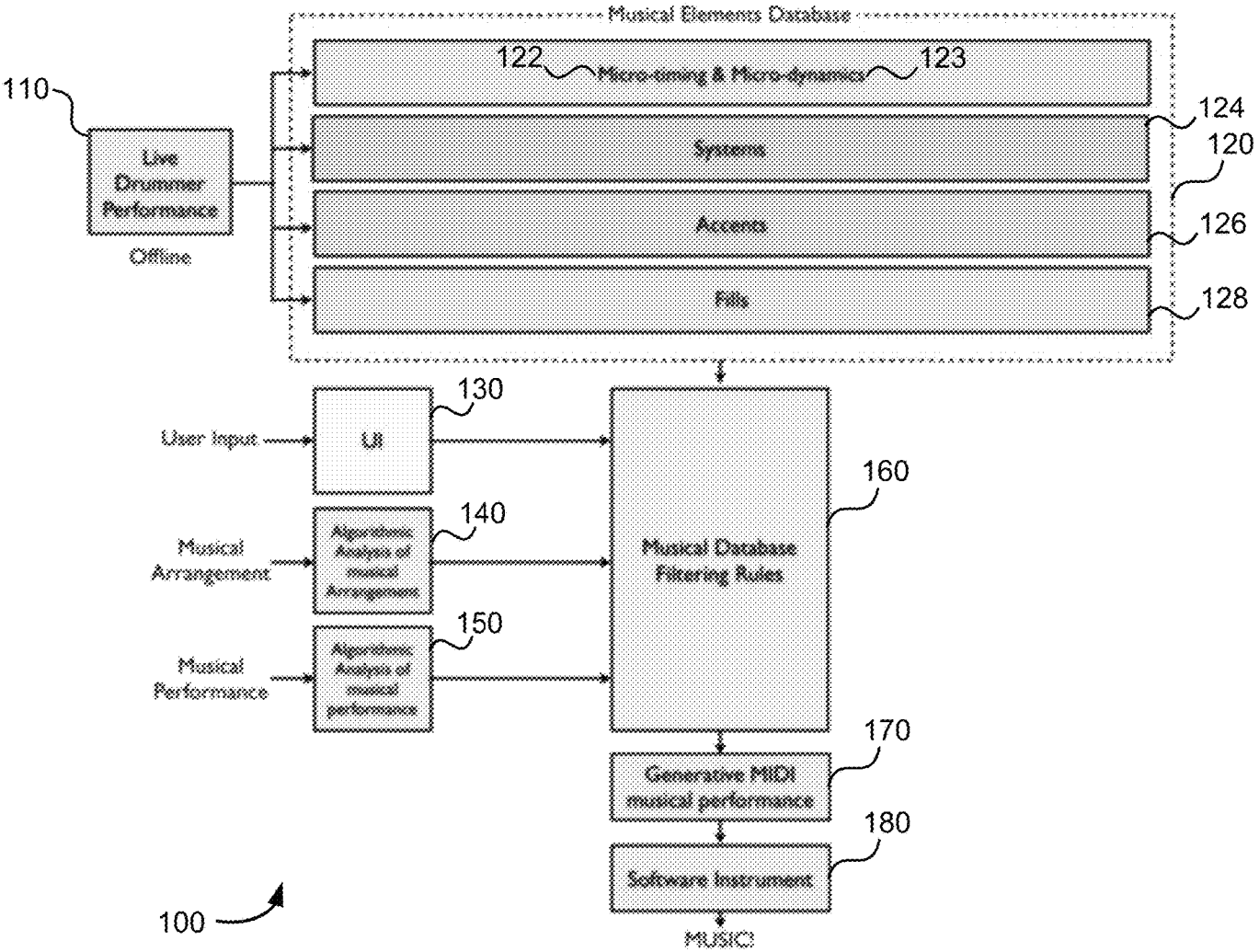
FIG. 1 is a simplified diagram illustrating aspects of a rhythmic accompaniment generation system for generating an accompaniment for a musical performance, according to an embodiment of the invention.

In the following description, for the purposes of explanation, specific details are set forth in order to provide a thorough understanding of embodiments of the invention. However, it will be apparent that various embodiments may be practiced without these specific details.

Certain embodiments of the invention relate to the automatic creation of a continuously changing rhythmic musical accompaniment for a given musical performance based on (1) customizable input parameters, (2) musical arrangement data, and (3) characteristics of the musical performance (i.e., musical performance data). For example, embodiments of the invention can analyze a live or recorded guitar track and automatically generate a suitable percussive accompaniment (e.g., drum track) based on characteristics of the performance (e.g., audio waveform, Musical Instrument Digital Interface (MIDI) data, etc.), characteristics of the arrangement (e.g., chorus, intro, etc.), and input parameters selecting a desired genre, stylistic embellishments, and more. Thus, a fully customizable automatic rhythmic accompaniment can be generated "on the fly" and manipulated in real-time for a realistic and human sounding performance.

In some embodiments, user customizable input parameters can include volume, accompaniment complexity, instrument type (e.g., drum kit type), genre type (e.g., rock, R&B, jazz, soul, etc.), shuffle controls, and more. By allowing a user to select a genre and change accompaniment parameters and characteristics, an appropriate rhythmic accompaniment can be created that better suits the musical performance. For example, a rock-and-roll style accompaniment may better suit a hard rock guitar performance than would a brushed jazz accompaniment. However, any desired combination of user parameters can be implemented.

In certain embodiments, musical arrangement data can identify the basic architectural elements of song, such as verse, chorus, bridge, or the like. Identifying a song section can be useful in determining an appropriate rhythmic accompaniment. For example, an intro to a song may be relatively quiet, subtle, or may slowly increase in volume and complexity, while a chorus section may be up front, loud, lively, and catchy. Consequently, one embodiment may generate an intro section with simple percussive arrangements at low volume with focus on rim shots and ping rides, and a chorus section with complex beats at high volume with a focus on kick and snare drums with crash cymbals. It should be noted that musical arrangement data can be an optional element and may not be required to generate a rhythmic accompaniment.

Musical performance data can be broken down to its elemental components such that the basic or fundamental underlying beat, known as an accent pattern, can be determined. Once the accent pattern of the musical performance is determined, a matching accent pattern (i.e., same fundamental beat) in a musical elements database can be used to create a suitably matching rhythmic accompaniment. Musical performance data can be in any suitable electronic form including audio sample(s), MIDI track(s), or other musical data of musical performances such as guitar riffs, piano melodies, bass lines, or any rhythm or melody from any real or virtual instrument. By determining the accent pattern of a musical performance, implementing user input parameters, and considering musical arrangement data, a very well suited rhythmic accompaniment for the musical performance can be automatically generated and customized to user preference. In some embodiments, the automatically generated rhythmic accompaniment can be generated passively or in real-time.

FIG. 1 is a simplified diagram illustrating aspects of a rhythmic accompaniment generation system (RAGS) 100 for generating an accompaniment for a musical performance, according to an embodiment of the invention. System 100 includes a musical elements database (MED) 120 that is electrically coupled to a musical database filtering block 160. A user interface 130, a musical arrangement block 140, and a musical performance block 150, are all communicatively coupled (e.g., electrically, optically, etc.) to filtering block 160. The output of filtering block 160 is communicatively coupled to MIDI generation block 170. MIDI generation block 170 is communicatively coupled to one or more software instruments 180.

Block 110 can be a live performance recorded offline and fed into the musical elements database 120. The recorded performances of block 110 can be used to establish a catalogued library of the various musical elements (e.g., accents, systems, etc.) that can be used to create the accompaniments described herein. Block 110 can be a live recorded drummer, however alternative embodiments may employ any suitable recordings, samples, etc., of the basic elements (e.g., accents, systems, fills, etc.) of percussive, melodic, or harmonic performances. For example, musical elements from guitar, bass, violin, piano, or other instrument, virtual or otherwise, can be used to populate the musical elements database 120. It should be noted that other alternative sources of musical elements can be implemented, as would be appreciated by one of ordinary skill in the art with the benefit of this disclosure.

Musical elements database 120 can be a vast library of basic elements that can be used to create a musical accompaniment. MED 120 can include micro-timing data 122, micro-dynamics data 123, system pattern 124, accent pattern data 126, and fills data 128. In some embodiments, micro-timing data 122 relates to shifting a note in time relative to a reference point typically by a small positive or negative amount to simulate a "feel" or groove of a particular style of music or playing style. In some aspects, micro-dynamics data 123 can include small rhythmic embellishments to simulate particular styles of music. For example, adding micro-dynamics may include adding double stick hits, flams, or ghost notes on a snare or tom-tom track. Accent pattern data 126 can relate to the basic elements of a given rhythm, i.e., the basic or fundamental beat. In some implementations, a plurality of stored accent pattern data, referred to as reference accent pattern data, is compared to accent patterns gleaned from musical performances (e.g., musical data) to find a closest match. Once an acceptable match is found, the reference accent pattern is used as a baseline or starting point in generating the rhythmic accompaniment, as further described below. System pattern data 124 can be an accompaniment pattern that can be combined with different accent patterns. For example, one system pattern may include a series of straight 8th note hi-hats, triplets, or any suitable configuration of notes that typically do not constitute an accent pattern. Fills data 128 typically includes one or more short breaks in a particular rhythm that "fills in the gaps" or, for example, indicates the end of a musical bar. It should be noted that although particular musical elements are described herein, more or fewer types of musical elements can be used to generate rhythms, as would be appreciated by one of ordinary skill in the art with the benefit of this disclosure.

User input block 130 can include a user interface to receive one or more user defined parameters to influence the musical accompaniment. Some definable parameters can include a performance volume, rhythmic complexity, instrument type (e.g., drum kit type), genre type (e.g., rock, jazz, fusion, R&B, alternative, folk, etc.), swing, focus (e.g., emphasis on kick, snare, or hi-hat, etc.), and more. In some cases, each definable parameter can be configured in a default setting, or can be controlled by macros or global preset values, as would be appreciated by one of ordinary skill in the art. In certain embodiments, input parameters may be automated in response to detected musical performance characteristics. For example, if a musical performance (i.e., performance data) is determined to have a fast tempo, with loud and frequent accents, then input parameters that complement those features may be automatically selected (e.g., increased volume, simple beat pattern, etc.). Input parameters are further discussed below with respect to FIGS. 5A-10.

Musical arrangement block 140 can perform an algorithmic analysis of a musical performance to identify the basic architectural elements of song, such as verse, chorus, bridge, or the like. This may be useful when generating an appropriate accompaniment for different portions of a song. For example, an accompaniment may tend to be livelier during a chorus section (e.g., louder, more complex, etc.) than during an intro section. In certain embodiments, musical arrangement data can be an optional element and may not be required to generate a rhythmic accompaniment.

Musical performance block 150 can be configured to perform an algorithmic analysis of a musical performance (e.g., guitar riff, piano riff, bass line, etc.) to determine its basic rhythmic components (e.g., accent pattern). The accent pattern of the musical performance can be matched with a number of reference accent patterns 126 in musical elements database 120 to help generate an appropriate rhythm accompaniment for the musical performance, as further discussed below. In some embodiments, system patterns, fills, micro-timing characteristics, and/or micro-dynamics characteristics can also be algorithmically determined, which can be used to determine which musical style of accompaniment would be most appropriate for the musical performance. For example, if the musical performance is very sloppy and consistently varies behind the beat, then RAGS 100 may generate a similarly patterned accompaniment.

Musical database filtering block 160 is configured to filter the musical elements database 120 based on inputs from the user input block 130, the musical arrangement block 140, and the musical performance block 150, to determine an appropriate combination of musical elements (i.e., accent patterns, system patterns, etc.) to create a suitable accompaniment for a particular musical performance. The selected combination of musical elements can be algorithmically based, probability and/or statistically based, rule based, or any suitable method of filtration and any combination thereof, as would be appreciated by one of ordinary skill in the art with the benefit of this disclosure.

To illustrate the filtering process, a non-limiting example is provided. According to an embodiment, filtering block 160 receives input parameters from input block 130 indicating a low volume, complex rhythm in a jazz style with a 50% shuffle feel and a high number of fills. The particular jazz style selected (selected by player "personality") is a style replete with micro-timing dynamics but few micro-timing shifts. Filtering block 160 receives an indication from musical arrangement block 140 that the rhythmic accompaniment is for a verse section. Finally, filtering block 160 receives an indication from musical performance block 150 that a musical performance has a particular accent pattern. Filtering block 160 accesses musical elements database 120 and filters through the library of musical elements (e.g., reference accent patterns, system patterns, etc.) to find a combination that meets the requirements of each input 130, 140, 150 (e.g., jazz style, shuffle feel, etc.). For example, filtering block 160 searches through and filters the library of reference accent patterns 126 to find one or more that match the accent pattern of the musical performance. The reference accent pattern is selected (e.g., by algorithmically selected, probability-based selection, etc.) and filtering block determines an appropriate combination of reference system patterns, reference fills, reference micro-dynamics, and reference micro-timing data based on the selected input parameters 130, 140, 150.

In certain embodiments, pattern generation is a modular framework with some custom made modules and script language that can filter, combine and modify patterns, based on the various input parameters described above. For example, certain patterns (e.g., accent patterns, system patterns, etc.) are sent through different modules that modify the "probability" of each pattern. In some cases, modules that modify probability may be drummer styles (see FIG. 6A-6C). Modules can be manually authored rules relating to the name and content of a particular pattern, or tables can be used that, for example, define how well specific pattern combinations work together either serially (relating to the previous pattern) or in parallel (e.g., relating to other parts like accents, fills, reference accent pattern, etc.). In some cases, additional to the filtering rules, certain events (e.g., notes, chords, etc.) can be added, deleted, or moved, their velocities or articulations can be changed, etc. Furthermore, some modules can define an interaction between different parts of the performance (e.g., systems reacting to accents), and apply timing and dynamics of the groove template patterns (further discussed below).

MIDI generation block 170 can generate a MIDI performance based on the combination of musical elements selected by filter block 160. In the example cited above, the MIDI-based rhythmic accompaniment may be a jazz-styled beat to accompany the musical performance. In summary, MIDI generation block 170 puts together a MIDI-based rhythmic accompaniment (e.g., drum beat) for the musical performance based on the filtered musical elements and input parameters received from filter block 160. In certain implementations, MIDI block 170 is the output of filter block 160. The output can be a MIDI pattern or sequence of single MIDI events that are combined in a MIDI region which is pasted into a MIDI track of a host digital audio workstation (DAW). The many possibilities of MIDI output configurations would be understood by one or ordinary skill in the art. In some implementations, other musical formats besides MIDI can be used.

Software instrument 180 can be any suitable MIDI player configured to play the MIDI performance generated by MIDI generation block 170. In some embodiments, filter block 160, MIDI generation block 170, and software instrument 180, or certain combinations thereof, may be performed by a single functional block of system 100, rather than multiple blocks (i.e., certain functional blocks have multiple functionalities). Similarly, other blocks (e.g., user input block 130 and musical arrangement block 140) can be functionally combined as desired.

Figure 2:
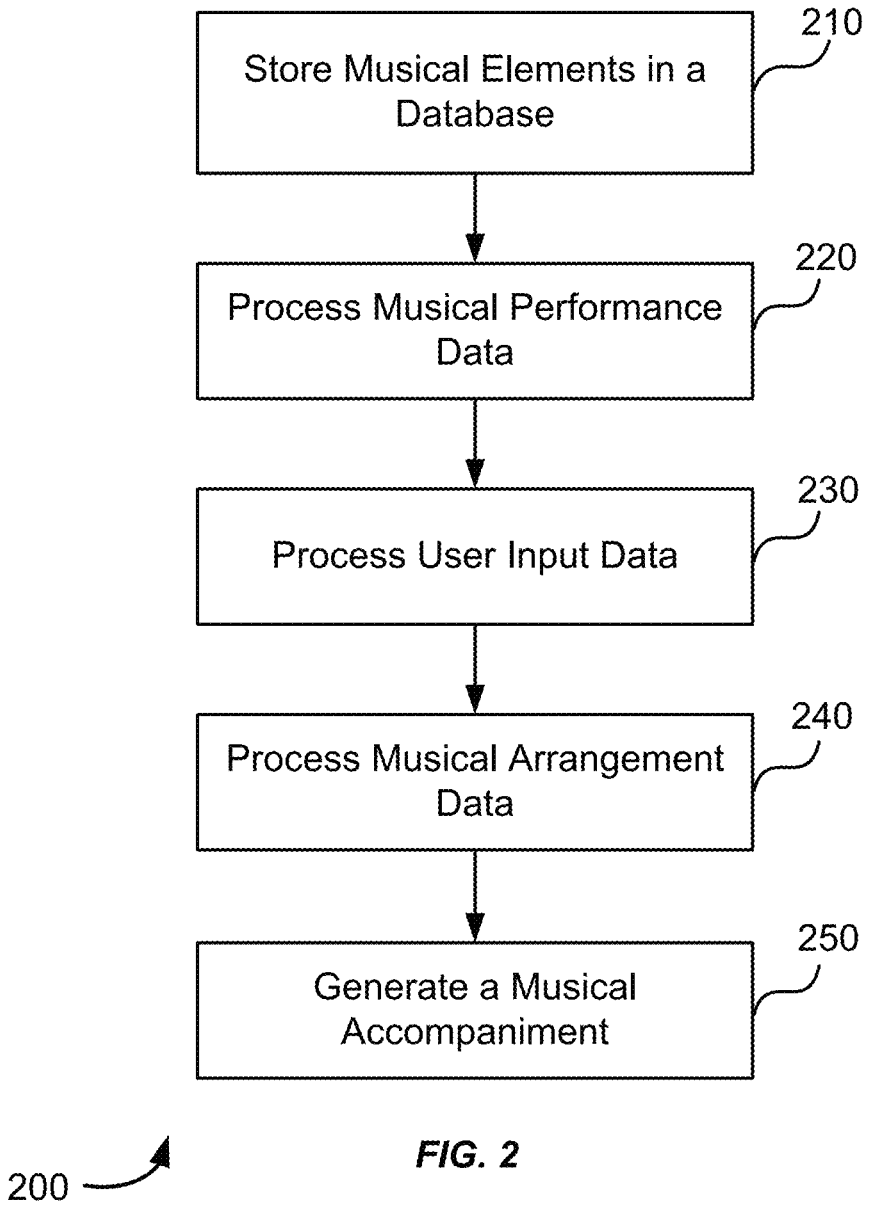
FIG. 2 is a simplified flow diagram illustrating aspects of a method of generating an accompaniment for a musical performance, according to an embodiment of the invention.

FIG. 2 is a simplified flow diagram illustrating aspects of a method 200 of generating an accompaniment for a musical performance, according to an embodiment of the invention. Method 200 can be performed by processing logic that may comprise hardware (e.g., circuitry, dedicate logic, etc.), software (which as is run on a general purpose computing system or a dedicated machine), firmware (embedded software), or any combination thereof. In one embodiment, method 200 is performed by elements of system 100 of FIG. 1. For example, method 200 can be performed by musical elements database 120, musical performance block 150, filter block 160 and MIDI generation block 170.

At 210, method 200 begins with storing a plurality of musical elements in a database. In some embodiments, the database can be musical elements database 120 of FIG. 1. The musical elements can include a plurality of reference accent pattern data, reference system pattern data, fills data, micro-timing data, micro-dynamics data, and more. The reference accent data can be a pattern of accentuated musical events (i.e., "reference accent pattern data") that defines the basic component elements or fundamental beat elements of a rhythm. System reference data can be a pattern of non-accent (i.e., non-accentuated) musical events and can be combined with accent patterns. Fills data 228 typically includes one or more short breaks in a particular rhythm that "fills in the gaps" or, for example, indicates the end of a musical bar. Micro-timing data 222 can relate to shifting a note in time relative to a reference point by a small positive or negative amount to simulate a "feel" or groove of a particular style of music. Micro-dynamics data 223 can include small rhythmic embellishments to simulate particular styles of music. Although particular musical elements are described herein, more or fewer types of musical elements can be used to generate rhythms, as would be appreciated by one of ordinary skill in the art with the benefit of this disclosure.

At 220, method 200 continues with algorithmically analyzing a musical performance to determine its basic rhythmic components. This can be generally referred to as processing performance data. Processing performance data can include receiving input data corresponding to a musical performance, determining one or more patterns of accentuated events in the musical performance, matching the pattern of accentuated events (i.e., accent pattern) from the musical performance to one or more reference accent patterns from the accent reference data of musical elements database 120, and selecting one of the matching reference accent patterns to generate an appropriate rhythm accompaniment for the musical performance, as further discussed below. In certain embodiments, the algorithmic analysis of a musical performance can be performed by musical performance block 150 of FIG. 1.

At 230, method 200 continues with receiving and analyzing input data that can include one or more automatically selected or user selected parameters (e.g., performance parameters) to influence the rhythmic accompaniment. This can be generally referred to as processing input data. Some definable parameters can include a volume, rhythm complexity, instrument type (e.g., drum kit type), genre type (e.g., musical styles including rock, jazz, fusion, R&B, alternative, folk, etc.), swing, focus (e.g., emphasis on kick, snare, or hi-hat, etc.), and more. In some cases, each definable parameter can be configured in a default setting, or can be controlled by preset values, as would be appreciated by one of ordinary skill in the art. In some embodiments, input data and any interface thereof (e.g., GUI, touch sensor interface, etc.) is controlled and operated by user input block 130 of FIG. 1.

At 240, method 200 includes analyzing arrangement data to determine the basic architectural elements of song, such as verse, chorus, bridge, or the like. This can be useful when generating an accompaniment for different portions of a particular song. For example, an accompaniment may tend to be livelier or showcase a "hook" during a chorus section (e.g., louder, more complex, etc.), rather than during an intro section. Thus, constantly changing song sections can lead to a continuously changing rhythmic accompaniment defined by the particular song section type, as well as the selected genre, existing tracks, player character attributes, user guided performance parameters, and the like. In some embodiments, arrangement data is not required or considered when creating a musical accompaniment and can be omitted from the accompaniment generation process. In some implementations, the arrangement analysis is performed by musical arrangement block 140 of FIG. 1.

At 250, method 200 includes generating a musical accompaniment using the processed performance data (e.g., selected musical elements from the database), the selected musical style, and the selected one or more musical performance parameters, where the musical accompaniment includes a plurality of musical elements (e.g., notes, chords, etc.) configured in a predetermined sequence (e.g., along a musical bar). The selected combination of musical elements can be algorithmically based, probability and/or statistically based, rule based, or the like. It should be noted that any suitable method of filtration and any combination thereof can be used. In some embodiments, the arrangement analysis is performed by the generative MIDI musical performance block 170 of FIG. 1. Although the examples provided herein describe musical accompaniment as MIDI-based, any suitable standard can be used, as would be appreciated by one of ordinary skill in the art with the benefit of this disclosure.

It should be appreciated that the specific steps illustrated in FIG. 2 provides a particular method of generating a rhythmic accompaniment for a musical performance, according to an embodiment of the present invention. Other sequences of steps may also be performed according to alternative embodiments. In certain embodiments, method 200 may perform the individual steps in a different order, at the same time, or any other sequence for a particular application. For example, alternative embodiments may determine an accent pattern for a musical performance and use that pattern in lieu of a reference accent pattern from musical elements database 120 to generate the rhythmic accompaniment. Moreover, the individual steps illustrated in FIG. 2 may include multiple sub-steps that may be performed in various sequences as appropriate to the individual step. Furthermore, additional steps may be added or removed depending on the particular applications. One of ordinary skill in the art would recognize and appreciate many variations, modifications, and alternatives of the method.

Input Data

Figures 3A, 3B, 3C, 3D, 3E, 3F:
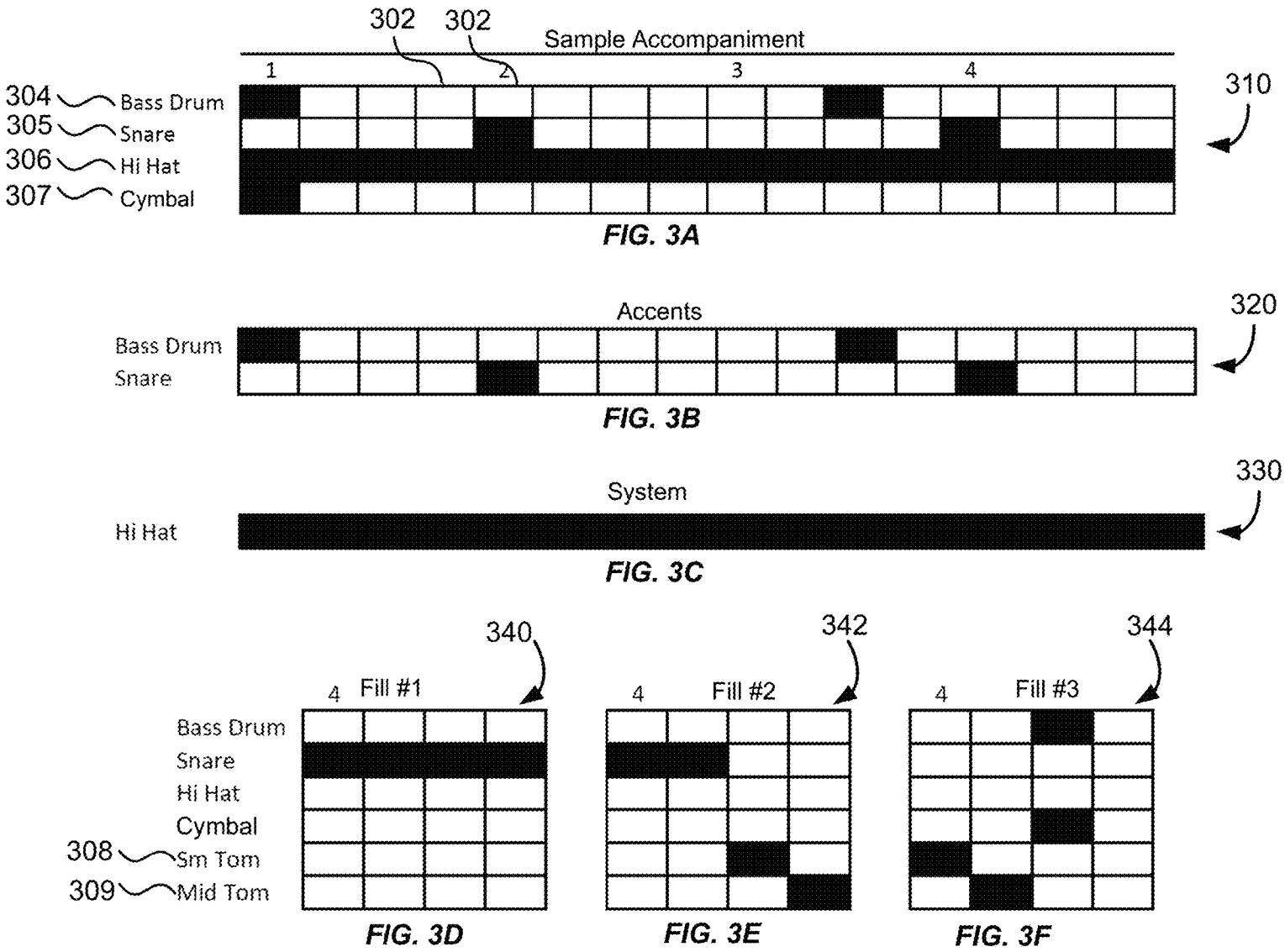
FIG. 3A illustrates a sample rhythm accompaniment utilizing basic musical elements, according to an embodiment of the invention.
FIG. 3B illustrates a sample accent pattern of rhythm accompaniment, according to an embodiment of the invention.
FIG. 3C illustrates a sample system pattern of rhythm accompaniment, according to an embodiment of the invention.
FIG. 3D illustrates a sample fill pattern, according to certain embodiments of the invention.
FIG. 3E illustrates a sample fill pattern, according to certain embodiments of the invention.
FIG. 3F illustrates a sample fill pattern, according to certain embodiments of the invention.

FIG. 3A illustrates a sample rhythm accompaniment 300 utilizing basic musical elements, according to an embodiment of the invention. Using accompaniment 300 as a basic model, musical elements including accents, systems, and fills are illustrated and described below. Accompaniment 300 depicts a four measure bar 310 with a given beat pattern in a sequenced format. In musical notation, a bar (or measure) is a segment of time defined by a given number of beats, each of which are assigned a particular note value. Dividing music into bars provides regular reference points to pin point locations within a piece of music. In this example, each measure has 4 beats for a total of 16 beats for the bar, although any suitable arrangement, grouping, number of beats, etc., can be used. Accompaniment 300 includes a bass drum track 304, snare drum track 305, a hi-hat track 306, and a cymbal track 307, with a plurality of quantizing segments 302 along the bar 310 for each track. Black sections indicate an event (e.g., note, chord, etc.) is present, and white indicates no event (e.g., silence). In the sequenced arrangement shown, a bass drum sample is triggered in the first beat of the first measure and the third beat of the third measure. A snare drum sample is triggered in the first beat of the second measure and the fourth measure. A hi-hat sample is triggered for every beat along the bar. A cymbal sample is triggered in the first beat of the first measure. Any suitable time signature, tempo, any number of tracks, any type of sample file, combination tracks, etc., can be used, as would be appreciated by one of ordinary skill in the art. The various samples described herein can be MIDI-triggered samples, or any other suitable format as would be appreciated by one of ordinary skill in the art with the benefit of this disclosure.

FIG. 3B illustrates a sample accent pattern 320 of rhythm accompaniment 300, according to an embodiments of the invention. Accent pattern 320 can be a pattern of accentuated musical events (e.g., "accent pattern data") that defines the basic component elements, main beat, or "essence" of a rhythm. In some cases, the accent can be broken down to a simple bass and snare drum pattern. However, other samples, sounds, and the like can be used to define the accent pattern (e.g., tom toms, crash cymbals, etc.). Other well-known accent patterns that can be used to define the basic beat of the song include the iconic kick-clap beat of Queen's "We Will Rock You," the kick-snare beat for the intro to Guns 'n Roses' "Paradise City," and the static bass-snare beat spanning most of Led Zeppelin's "Kashmir." In some embodiments, reference accent patterns are stored in a musical elements database 120 and can be divided into separate libraries containing $8^{th}$ note and $16^{th}$ note positions. However, any type of reference accent patterns can be stored (e.g., $32^{nd}$ note positions, etc.) as required by design.

FIG. 3C illustrates a sample system pattern 330 of rhythm accompaniment 300, according to an embodiment of the invention. System patterns can be a pattern of non-accent musical events and can be combined with accent patterns. For example, a system pattern may include eighth note or triplet patterns that one may expect to hear a drummer play on a hi-hat or ride cymbal. In this example, system pattern 330 includes a hi-hat pattern triggered for every beat along the bar. Fewer beats, more beats, or any configuration of system patterns can be used, as would be appreciated by one of ordinary skill in the art. Furthermore, system patterns can be very simple to very complex and can employ any number of samples (e.g., combination of hi-hats and tom-toms, etc.) to create the system pattern. In some embodiments, system patterns are independent of the other musical elements (e.g., independent of accent patterns, fills, etc.).

FIGS. 3D-3F illustrate a sample fill pattern 340, according to certain embodiments of the invention. Fill patterns typically include one or more short breaks in a particular rhythm that "fills in the gaps" or, for example, indicates the end of a musical bar. Fill 340 of FIG. 3D, for example, includes a series of snare samples that may be heard at the end of a musical bar. Fill 342 of FIG. 3E includes two snare hits followed by a short drum roll across small 308 and medium 309 tom-tom drum tracks. Fill 344 of FIG. 3F includes a short drum roll followed by a kick and cymbal crash. Fills can be of any length, style, or characteristic, as would be appreciated and practically applied by those of ordinary skill in the art.

Figures 4A, 4B, 4C, 4D:
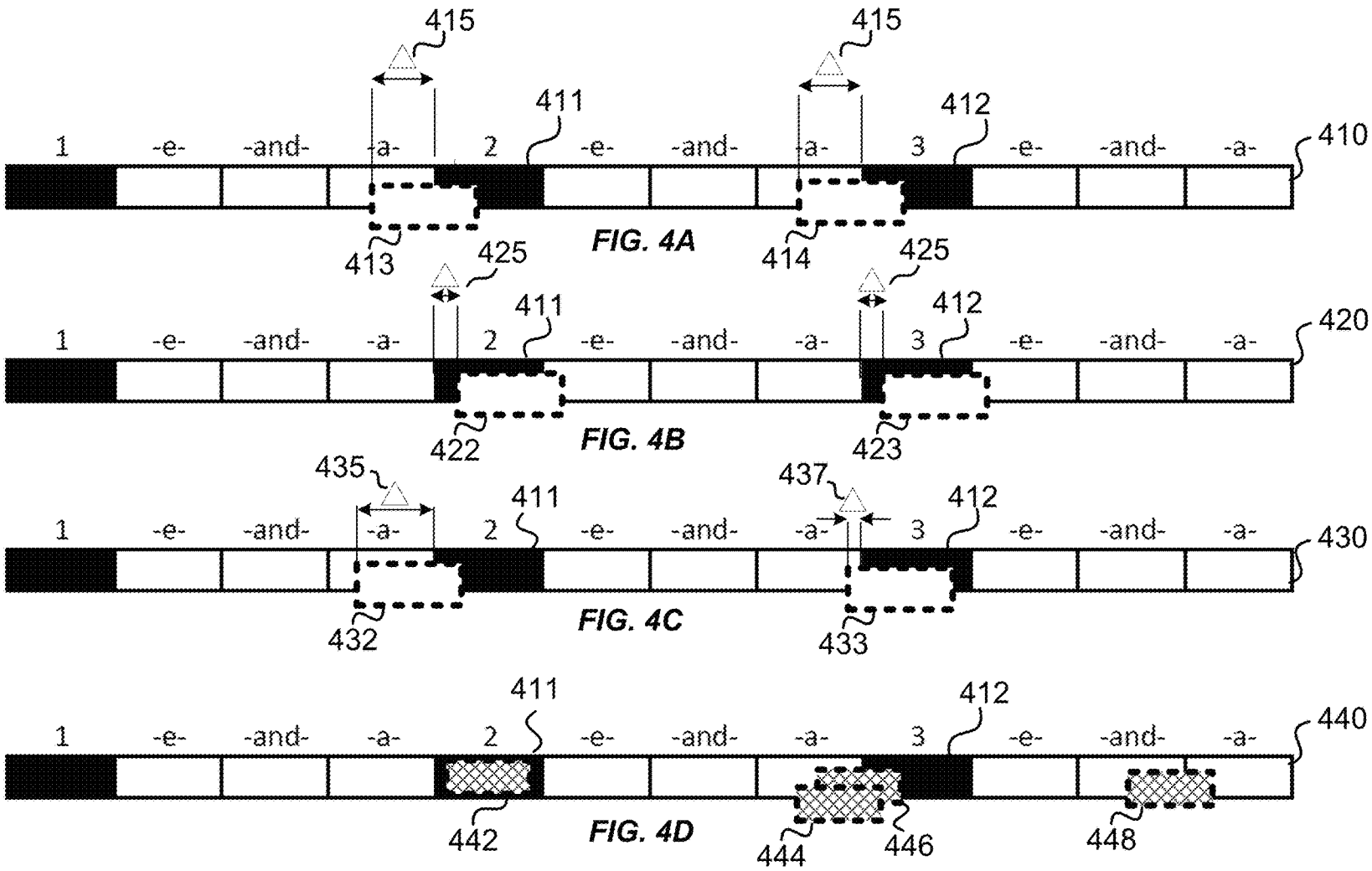
FIG. 4A illustrates a simplified example of micro-timing changes to a note, according to an embodiment of the invention.
FIG. 4B illustrates a simplified example of micro-timing changes to a note, according to an embodiment of the invention.
FIG. 4C illustrates a simplified example of micro-timing changes to a note, according to an embodiment of the invention.
FIG. 4D illustrates a simplified example of adding micro-dynamics and embellishments to a beat, according to an embodiment of the invention.

FIG. 4A is a simplified diagram illustrating an example of implementing micro-timing changes to a note, according to an embodiment of the invention. Micro-timing changes can include shifting a note in time relative to a reference point by a small positive or negative amount to simulate a "feel" or groove of a particular style of music or a particular propensity of a certain drummer. For example, some drummers may tend to play slightly before or after the beat. Simulating these small micro-timing changes in a note can make an exacting computer-generated beat sound more realistic. Bar 410 includes a sequence of segments with a snare sample triggered at measure 1, 2, and 3, as indicated by the filled segments 411 and 412. Snare note 413 illustrates a substituted snare sample with a negative shift of delta 415 from segment 411. Snare note 414 illustrates a substituted snare sample 414 with a similar negative shift of delta 415 from segment 412. By implementing micro-time shifted snare samples 413, 414, the snare beat sequence emulates a player who plays certain notes slightly before the beat. It should be noted that the various "notes" or "chords" described herein can be events. For example, a MIDI event can be any note, chord, metadata, or any suitable type of data associated with a position along a musical bar or suitable time reference.

FIG. 4B illustrates a simplified diagram illustrating an example of implementing micro-timing changes to a note, according to an embodiment of the invention. Bar 420 includes a sequence of segments with a snare sample triggered at measure 1, 2, and 3, as indicated by the filled segments 411 and 412. Snare note 422 illustrates a substituted snare sample with a positive shift of delta 425 from segment 411. Snare note 423 illustrates a substituted snare sample with a similar positive shift of delta 425 from segment 412. By implementing micro-time shifted snare samples 413, 414, the snare beat sequence emulates a player who tends to play certain notes slightly after the beat.

FIG. 4C illustrates a simplified diagram illustrating an example of implementing micro-timing changes to a note, according to an embodiment of the invention. Bar 430 includes a sequence of segments with a snare sample triggered at measure 1, 2, and 3, as indicated by the filled segments 411 and 412. Snare note 432 illustrates a substituted snare sample with a large negative shift of delta 435 from segment 411. Snare note 414 illustrates a substituted snare sample with a smaller negative shift of delta 437 from segment 412. By implementing micro-time shifted snare samples 432, 433, the snare beat sequence emulates a "sloppy" or "loose" player who tends to play before the beat. This may be desired for more of a raw or "garage" type performance, which may be a suitable accompaniment for certain styles of music (e.g., punk, hardcore, rock, etc.).

FIG. 4D illustrates a simplified example of adding micro-dynamics and embellishments to a rhythmic accompaniment, according to an embodiment of the invention. Micro-dynamics can include small rhythmic embellishments to simulate particular styles of music. In some cases, micro-dynamics can be related to the velocities of events (e.g., playing notes or events louder or softer). Bar 440 includes a sequence of segments with a snare sample triggered at measure 1, 2, and 3, as indicated by the filled segments 411 and 412. Snare note (event) 442 depicts a softer played snare event as indicated by the smaller box 442. Alternatively, the snare event may be louder (larger box 442). In certain implementations, rhythmic embellishments may be used to enhance a performance. Snare events 444, 446, and 448 illustrate additional snare hits (e.g., double strokes, flams, rolls, ghost notes, etc.) to add stylistic flare to an otherwise static snare beat. The notes are typically added to the performance, rather than substituted like micro-timing changes. Embellishments can include extra notes, ghost notes, and the like, and can be placed in any suitable location in the rhythm. In addition to note location, micro-dynamics can include changes in note tone, color, timbre, and more, as would be appreciated by one of ordinary skill in the art with the benefit of this disclosure.

Figure 5A:
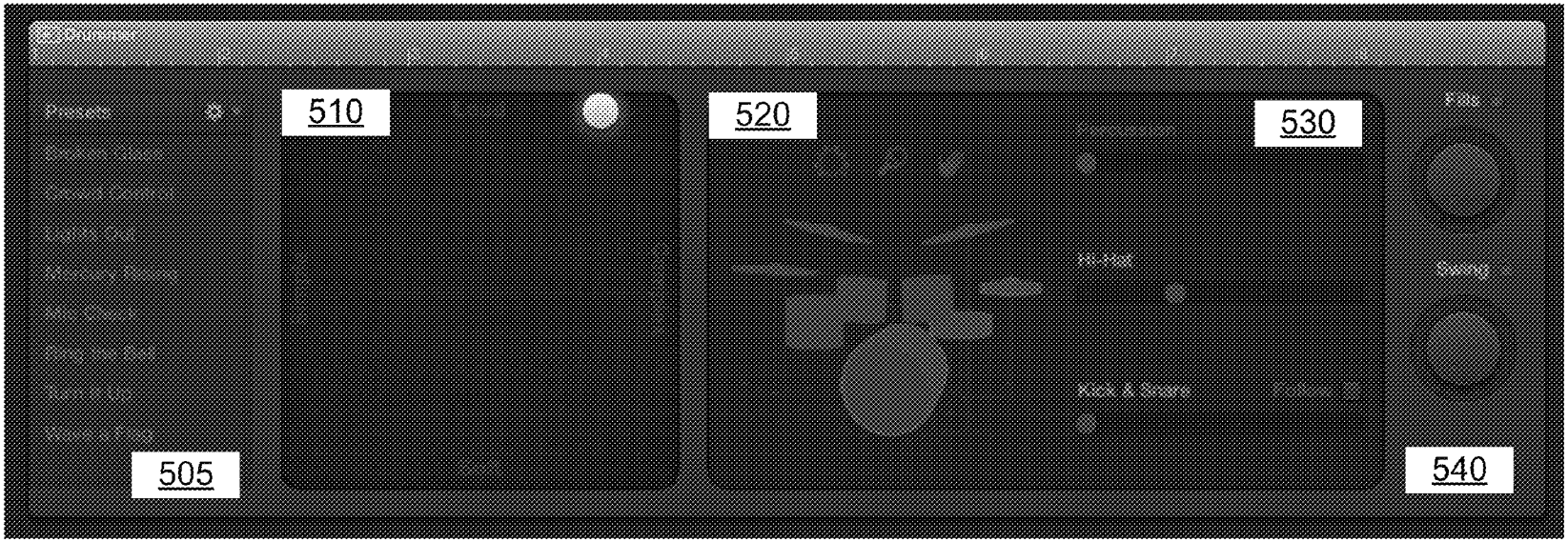
FIG. 5A illustrates an input interface for a rhythm accompaniment generation system, according to an embodiment of the invention.

FIG. 5A illustrates an input interface 500 for a rhythm accompaniment generation system, according to an embodiment of the invention. Input interface 500 includes a number of configurable input elements including Preset selector 505, X-Y Pad 510, Focus Element Selector 520, element presets 530, and input knobs 540. The depiction of input interface 500 is but one of any number of configurations or representations, and any number of configurable inputs can be added or removed in any suitable format or configuration. In certain embodiments, the input interface is a user interface configured to receive input from a user to change or control certain characteristics of the generated rhythm accompaniment, as further described below.

Figure 5B:
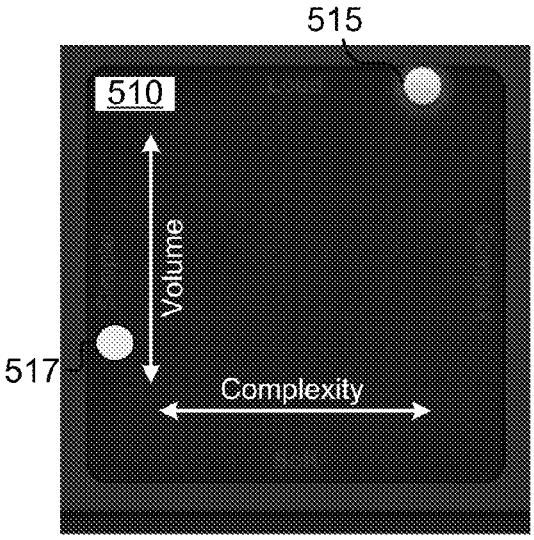
FIG. 5B illustrates an X-Y Pad configured to control the complexity and volume of the resulting rhythm accompaniment, according to an embodiment of the invention.

FIG. 5B illustrates an X-Y Pad 510 configured to control the complexity and volume of generated rhythm accompaniment, according to an embodiment of the invention. Movement along the X-axis affects the complexity of the rhythm accompaniment. Movement along the Y-axis affects the volume (i.e., intensity) of the rhythm accompaniment. A user manipulable puck 515 can be maneuvered around the X-Y Pad 510 to affect the complexity and volume of the rhythm accompaniment based on its location. The puck (or any control element thereof) can be controlled by a user, by automation, preset configurations, or the like. As shown, puck 515 is configured to produce a very loud (i.e., maximum volume) and substantially complex (i.e., near maximum complexity) rhythm accompaniment based on its relative position in the X-Y domain. Puck 517, on the other hand, is positioned to produce a relatively soft or low volume and a very simple (i.e., minimum complexity) accompaniment based on its relative position in the X-Y domain. Typically, only one puck is used in X-Y Pad 510 and multiple pucks are shown here for illustration.

Figure 5C:
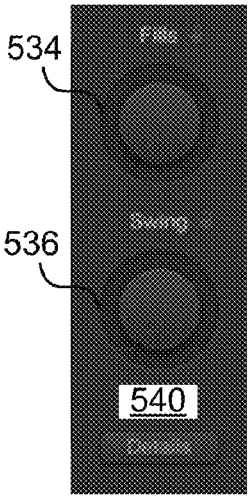
FIG. 5C illustrates input knobs configured to control rhythm characteristics, according to an embodiment of the invention.

FIG. 5C illustrates input knobs 540 configured to control rhythm accompaniment characteristics, according to an embodiment of the invention. Input knobs 540 includes a fills control 534 and a swing control 536. Fills control 534 controls the likelihood of fills being played in a given rhythmic accompaniment. For example, with fills control 534 set at 25%, the likelihood of a drum fill being played at the end of a particular bar is relatively low (e.g., 25% of the time at the end of an 8 bar or 16 bar groove). Conversely, with fills control 534 set at 95%, the likelihood of a drum fill being played at the end of a particular bar or throughout the rhythmic accompaniment is very high (e.g., 95% of the time at the end of an 8-bar or 16-bar groove, as well as interspersed fills throughout the rhythm). Swing control 536 controls an amount of shuffle "feel" currently playing in the rhythm accompaniment. In some embodiments, swing control 536 can be associated with particular groove templates as further described with respect to FIGS. 6-9. In some cases, the intensity and complexity of the fills are related to the intensity and complexity of the beat, as set in X-Y pad 510. Fills and swing characteristics are well understood by those of ordinary skill in the art.

Figure 5D:
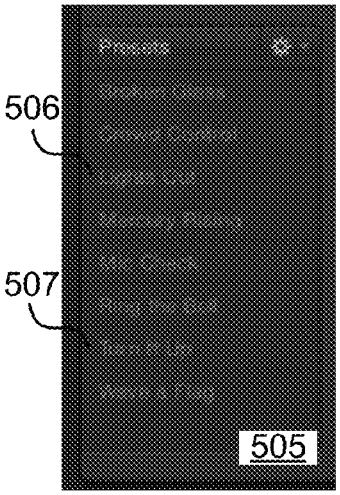
FIG. 5D illustrates a preset selector for an input interface, according to an embodiment of the invention.

FIG. 5D illustrates a preset selector 505 for an input interface 500, according to an embodiment of the invention. Preset selector 505 includes a number of presets (e.g., 506, 507) with global or macro-like properties to allow a quick selection of characteristics across some or all of the configurable input elements. For example, the "Light's Out" preset 506 may produce a simple, low volume accompaniment (e.g., via X-Y Pad 510) with low swing (e.g., swing control 536) and few fills (e.g., fill control 534). Any number of presets and preset configuration can be used and are not limited by the examples described herein.

Figure 5E:
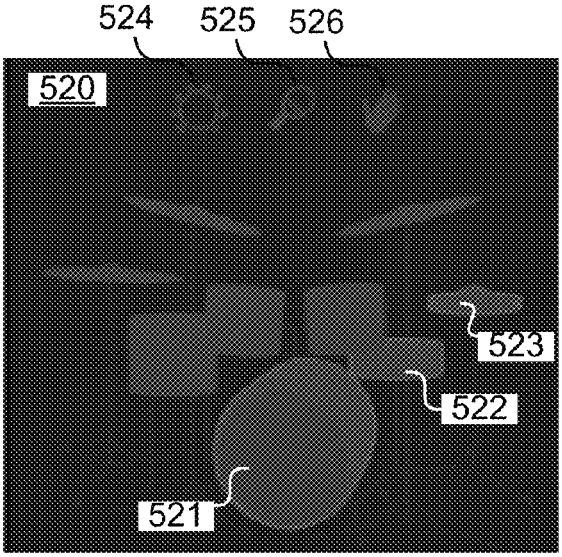
FIG. 5E illustrates a focus element selector for a rhythmic accompaniment, according to an embodiment of the invention.

FIG. 5E illustrates a focus element selector 520 for a rhythmic accompaniment, according to an embodiment of the invention. Focus element selector 520 includes images of a tambourine 524, a shaker 525, a hand clap 526, and a drum kit including bass drum 521, snare drum 522, and hi-hat 523. In practice, focus selector 520 allows a user to select a particular rhythmic focus for an accompaniment. For example, selecting snare 522 will cause the rhythmic accompaniment to have an emphasis on snare hits and possibly assign snare hits to accent notes. Similarly, selecting hand clap 526 will cause the rhythmic accompaniment to include an increased number of hand claps. In some embodiments, selecting a focus element (e.g., snare 522) causes the rhythm accompaniment system pattern to place an emphasis on the selected element. In other words, selecting snare 522 causes a heavy snare-laden system pattern, accent pattern, or any combination thereof to be generated. Other drum elements may be included (e.g., tom-toms, rides, crash cymbals, etc.) and function similarly as described herein. In some embodiments, multiple elements can be selected as focus elements. Furthermore, kit pieces (e.g., hand clap, cymbals, toms, etc.) can be enabled and disabled through the same interface.

Figure 5F:
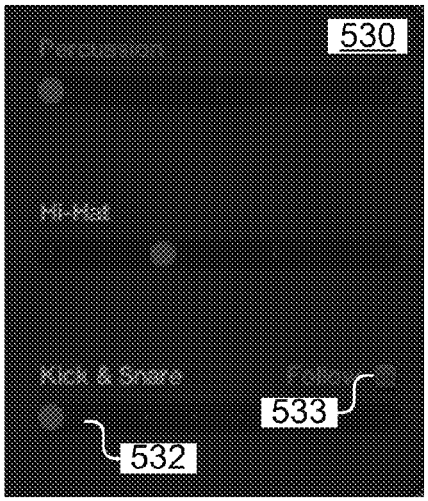
FIG. 5F illustrates element presets for a rhythmic accompaniment, according to an embodiment of the invention.

FIG. 5F illustrates element presets 530 for a rhythmic accompaniment, according to an embodiment of the invention. Kick and snare preset 532 includes a number of preset combinations of kick and snare beats that can be applied to the rhythmic accompaniment. In some embodiments, the kick and snare beats are applicable to a predetermined accent pattern. For example, by pressing the "follow" button 533, the kick and snare patterns include accent patterns similar to the accent pattern of the musical performance, as determined by musical performance block 150 of FIG. 1. In certain implementations, other presets including hi-hat, percussion (e.g., tambourine, hand clap, etc.), or the like, can be included as element presets 530. In some aspects, element presets 530 include a slider with fixed values to switch between different variations of certain aspects of a performance, as described above (e.g., different kick/snare patterns for a particular performance, etc.). Similarly, some elements can include further controls to change their tonal characteristics, such as tuning kit pieces, opening/closing a the hi-hat, changing the relative intensity of ghost notes or other syncopated strokes on a kick/snare performance, etc.

As described above, a rhythmic accompaniment can be based on a musical performance (e.g., on track 1). Alternatively, a rhythmic accompaniment can be based on multiple tracks (e.g., guitar track and bass track). For example, a rhythmic accompaniment may be based on an accent pattern of the guitar track and later switch to an accent pattern of the bass track. In some cases, the rhythmic accompaniment may be based on a combination of accent pattern elements from both tracks.

Figure 6A:
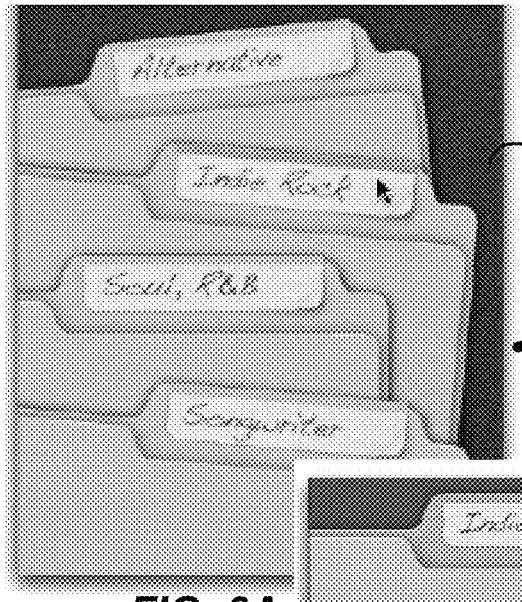
FIG. 6A illustrates a plurality of selectable drumming styles for different musical genres to be applied to a rhythmic accompaniment, according to an embodiment of the invention.

FIG. 6A illustrates a plurality of selectable drumming styles 610 for a variety different musical genres to be applied to a rhythmic accompaniment, according to an embodiment of the invention. Drumming styles can be used as a macro or preset to quickly select and filter certain desired musical characteristics from a vast assortment of possibilities. The drum styles may include a particular genre of music, micro-timing and micro-dynamic characteristics, kit piece elements (e.g., type of drum kit, types of drum pieces used, etc.), and the like. The drumming styles 610 shown in FIG. 6A includes alternative rock, indie rock, soul and R&B, and songwriter styles. Each genre includes certain stylistic characteristics including kit piece types, playing styles, etc., that are representative of that particular style, and may include further sub-genres therein, as shown and described in FIG. 6B below. It should be understood that any number of styles can be used (e.g., jazz, pop, reggae, metal, punk, etc.) and implemented in a similar fashion. In certain embodiments, drumming styles may be reviewable, accessible, and selectable in a user interface controlled and/or operated by user input block 130. Although drumming styles are primarily discussed herein, it should be understood that rhythmic accompaniments may be generated that include stringed instrument, wind instrument, brass instrument, etc., sounds and/or samples, in addition to or instead of a percussive drum-based accompaniment. For example, "drumming styles" may be guitar styles with each genre including elements of guitar that are typically included in a specific genre (e.g., tight $9^{th}$ chords stabs with a clean tone may be associated with funk guitar). The nearly limitless applications, permutations, and appropriate samples and sounds that could apply to the various types of rhythmic accompaniments and their application to the novel concepts described herein would be appreciated by one of ordinary skill in the art with the benefit of this disclosure.

Figure 6B:
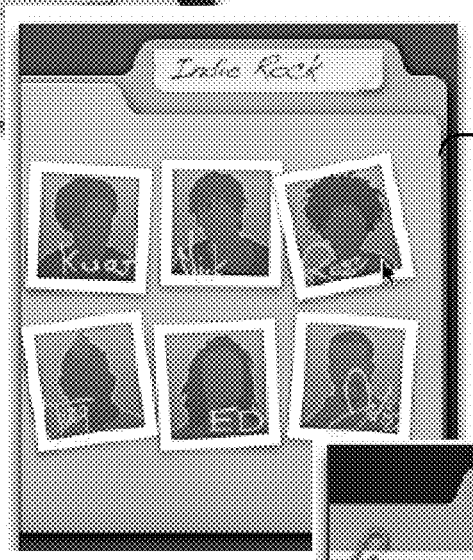
FIG. 6B illustrates a number of drumming styles within the indie rock genre, according to an embodiment of the invention.

FIG. 6B illustrates a number of drumming styles within the indie rock genre, according to an embodiment of the invention. Selecting "indie rock" from the number of genres depicted in FIG. 6A opens a folder featuring a plurality of selectable drum "personas," (e.g., "Kurt," "Julio," "Rose," etc.) each providing a particular musical "style" with unique stylistic nuances to the rhythmic accompaniment while still retaining stylistic elements of the base genre. For example, "Julio" may exhibit different micro-timing and micro-dynamic characteristics than "Rose" or "Kurt," and be well-suited for a particular range of tempo, but still retain basic elements of indie rock type performances.

Figure 6C:
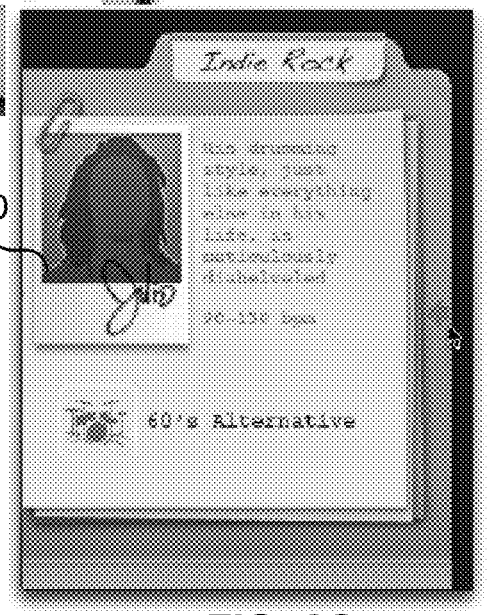
FIG. 6C illustrates a particular drumming style within the indie rock style, according to an embodiment of the invention.

FIG. 6C illustrates a particular drumming style 630 within the indie rock style, according to an embodiment of the invention. The drumming style personified as "Julio" is described as "60's alternative" and "disheveled." In one embodiment, this style can be a particularly sloppy drum style with fluctuating micro-timing shifts, but tastefully embellished micro-dynamics that imply the 1960's style of rock. It should be noted that any number of personalities, styles, embellishments, or the like, can be grouped or associated in any desired combination and the "personas" described herein can function as presets to affect the overall sound and style of the rhythmic accompaniment. For example, the "Julio" persona described above can provide presets for song complexity and volume as well as a small amount of swing in generated beats. These same parameters can be individually changed at will and can be simply used as starting points for achieving a desired sound or style. In some embodiments, new personas can be created and customized to taste. For example, a customized persona named "Animal" may include maximized values for volume and fills with minimized shuffle and a double bass kit piece. Any combination of configurable parameters can be combined and assigned to personal preference.

Groove templates can be selected to change certain musical characteristics of a rhythmic accompaniment. In some embodiments, groove templates are related to micro-timing and micro-dynamic changes. To illustrate groove template implementation, the process typically begins with receiving musical data. The musical data typically includes reference timing data and a succession of musical notes arranged with respect to the reference timing data. For example, this can include an arrangement of musical notes (e.g., MIDI notes) along a musical bar. The musical bar includes reference timing data such as a tempo, a timing of individual notes, etc., as would be known by one of ordinary skill in the art. A groove template can then be selected (e.g., musical style) and the arrangement of musical notes is then altered based on the selected musical style. The manner in which the notes are altered include positive or negative note position shifts from an initial position, additional notes for embellishment, and more, as described below.

Figure 7A:
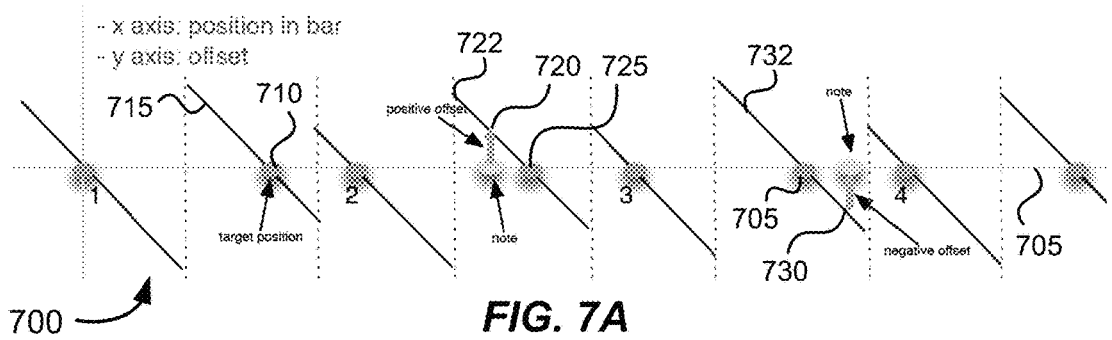
FIG. 7A illustrates a conventional method of applying a shuffle groove to a Musical Instrument Digital Interface (MIDI) performance, according to an embodiment of the invention.

FIG. 7A illustrates a conventional method of applying a shuffle groove to a MIDI performance 700, according to an embodiment of the invention. In one embodiment, a shuffle groove can utilize an offset-based interpolated non-continuous groove template that can be applied to a series of notes along a bar (e.g., MIDI performance). The shuffle groove template operates to shift notes along a musical bar by a certain amount depending on their position relative to a target position to create an artificial "shuffle" groove. MIDI performance 700 includes notes 720 and 730, with the X-axis depicting the position of the notes along bar 705, and the Y-axis depicting an amount of offset applied at each position along bar 705. The diagonal lines 715, 722 indicate a predetermined positive or negative offset applied to a note relative to a target position 710, 725. In the embodiments shown, the positive and negative offsets are non-continuous. For example, diagonal line 715 starts positive and decreases linearly to a negative value, followed by another diagonal line beginning again at a positive value. In one non-limiting example, note 720 is located just left of target position 725. The positive shift is defined by the magnitude of the y-axis displacement of the diagonal line 722 directly above note 720. The positive shift is then applied to move note 720 toward target position 725 to create a "shuffle" sound. In another example, note 730 is shown just right of target position 705, thus a negative shift defined by diagonal line 732 is applied to move note 730 toward target position 705. In general, the amount of shift required to create the shuffle feel is defined by the placement of the target positions and the amount of shift associated with each position along the bar. Thus, when applying groove templates in this manner, all notes are set to their nearest target position or moved towards nearest target position by a certain amount (e.g., percentage), which leads to a non-continuous offset function. Non-continuous offset functions can sound unnatural to the human ear and would not typically emulate what a real player would do in practice.

Figure 7B:
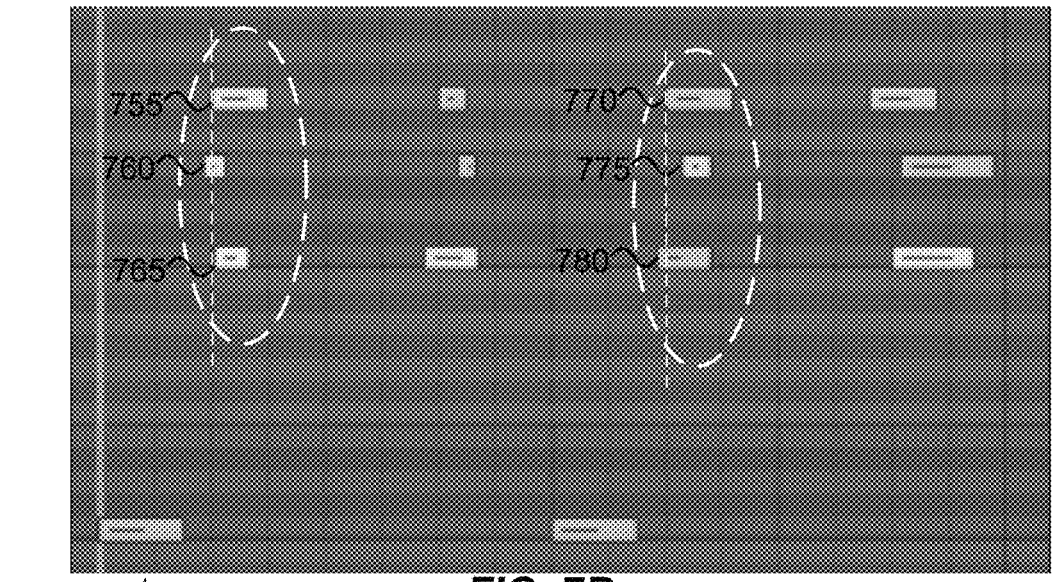
FIG. 7B illustrates a MIDI pattern of arpeggiated chords prior to applying a non-continuous shuffle groove template, according to an embodiment of the invention.

FIG. 7B illustrates a MIDI pattern 750 of arpeggiated chords prior to applying a non-continuous shuffle groove template, according to an embodiment of the invention. MIDI notes 755, 760, and 765 are configured in a chord configuration with slight offsets shown between each vertically adjacent note (i.e., notes 755, 760, and 765 form an arpeggiated chord). Similarly, notes 770, 775, and 780 are configured as an arpeggiated chord but have more significant offsets between vertically adjacent notes. The small offsets between vertically adjacent notes are indicative of realistic sounding chords (e.g., arpeggiation) since a real player would be unlikely to hit each note at exactly the same time, or may intend to hit place small deltas between notes for certain stylistic effects.

Figure 7C:
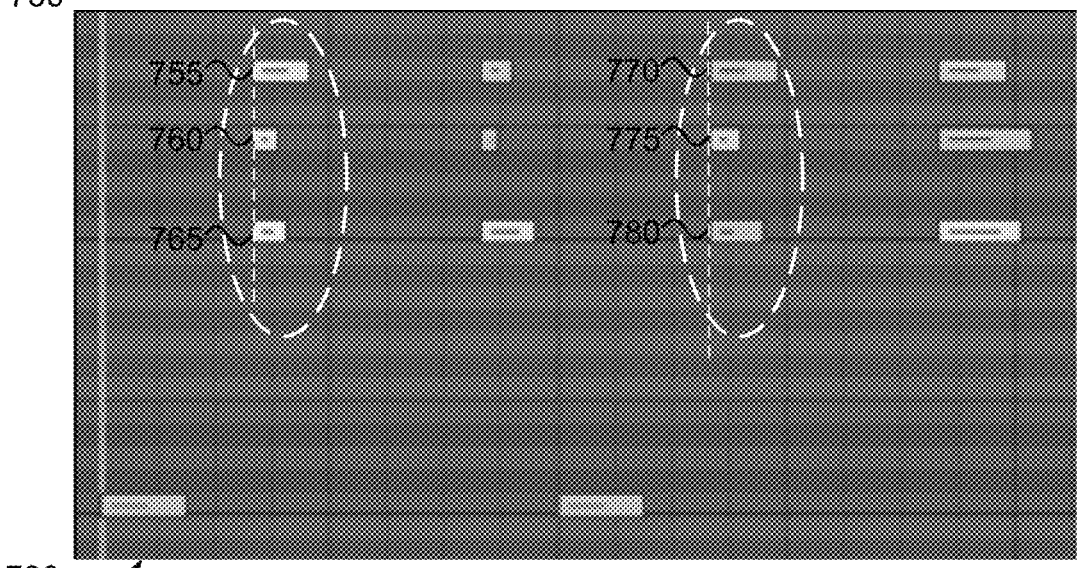
FIG. 7C illustrates a MIDI pattern of arpeggiated chords after applying a non-continuous shuffle groove template, according to an embodiment of the invention.

FIG. 7C illustrates a MIDI pattern 780 of arpeggiated chords after applying a non-continuous shuffle groove template, according to an embodiment of the invention. As shown, applying an $8^{th}$ note swing groove template to the chords of FIG. 7B causes all of the notes of each chord to be quantized to the exact same position. For example, notes 755, 760, and 765 are aligned to exactly the same position. Similarly, notes 770, 775, and 780 are also aligned to the same position. Although the notes have been shifted toward the target notes to simulate a swing feel, the note placement is quantized and exacting, resulting in an unnatural and mechanical sounding performance. As a result, common drum articulations like flams, drags, and rolls, for example, would be eliminated using this approach.

Figure 8A:
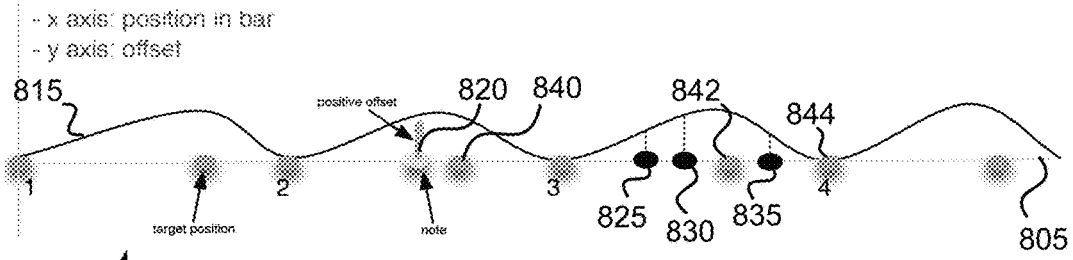
FIG. 8A illustrates an improved method of applying a shuffle groove to a MIDI performance, according to an embodiment of the invention.

FIG. 8A illustrates an improved method of applying a shuffle groove to a MIDI performance 800, according to an embodiment of the invention. In an embodiment, a shuffle groove can utilize a positive offset-based interpolated continuous groove template that can be applied to a series of notes along a bar (e.g., MIDI performance). The shuffle groove template operates to shift notes along a musical bar by a certain amount depending on their position relative to a target position to create a "shuffle" groove (i.e., shuffle dynamic). MIDI performance 800 includes notes 820, 825, 830 and 835, with the X-axis depicting the position of the notes along bar 805, and the Y-axis depicting an amount of offset applied at each position along bar 805. Offset line 815 indicates a predetermined positive offset applied to a note relative to a target position 840, 842, 844 at each point along bar 805. In one non-limiting example, note 820 is located just left of target position 840 and a positive shift defined by offset line 815 is applied to move note 820 toward target position 840 to create a "shuffle" sound. In a second example, note 825 is shown left of target position 842 and a positive shift proportional to distance between note 825 and offset line 815 is applied to move note 825 toward target position 842. In a third example, note 830 is shown left of target position 842 and a positive shift proportional to distance between note 830 and offset line 815 is applied to move note 830 toward target position 842. In a fourth example, note 835 is shown left of target position 844 and a positive shift proportional to distance between note 835 and offset line 815 is applied to move note 835 toward target position 844. In some embodiments, the continuous groove template varies in offset between target positions where substantially no offset is associated with target positions and where offset generally increases in non-target positions located progressively farther from their next target position in the positive direction. Continuous groove templates can be curved, linear, or any combination thereof.

In this particular eighth note shuffle template, only positive shifts are applied to the notes. Furthermore, offset line 815 is continuous with no gaps or breaks in continuity in-between, even when looped end to end in successive musical bars, with an offset value specified for every possible position in the bar. Thus, with a continuous offset, the relative position of notes (e.g., arpeggiated notes) remains intact, as shown below in FIGS. 8B-8C, resulting in a very realistic and authentic sounding shuffle sound. Therefore, a shuffle groove can be added to a series of notes and chords while preserving the original feel of the performance. Moreover, multiple layered groove templates can be applied to a sequence of notes and chords, where each layer can retain its qualities independent of one another, as further described below with respect to FIG. 10. Although the continuous groove template described above applies a shuffle groove, it should be understood that any of the types of grooves (e.g., micro-timing shifts, micro-dynamics, etc.) can also use the continuous groove concepts described herein.

Figure 8B:
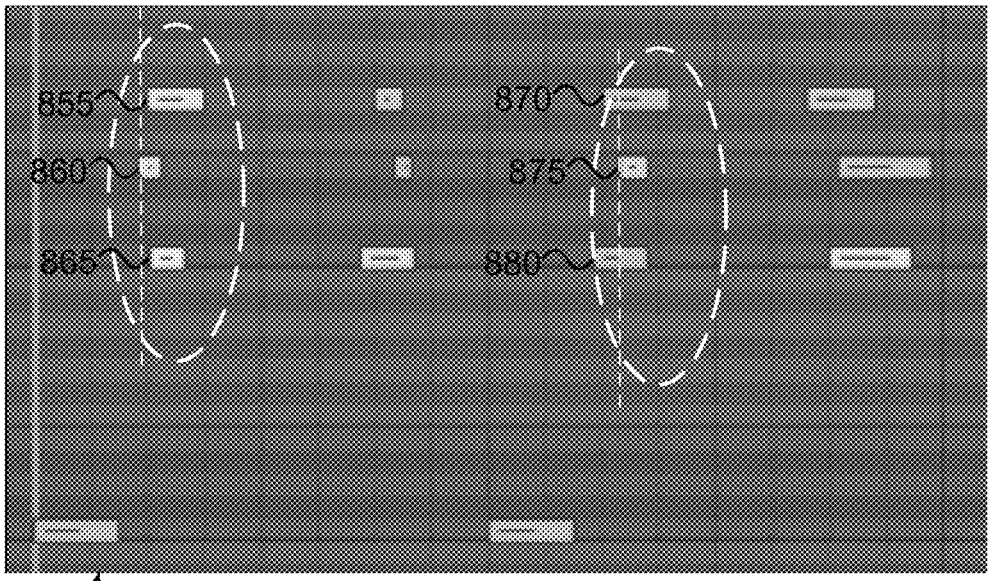
FIG. 8B illustrates a MIDI pattern 850 of arpeggiated chords prior to applying a continuous shuffle groove template, according to an embodiment of the invention

FIG. 8B illustrates a MIDI pattern 850 of arpeggiated chords prior to applying a continuous shuffle groove template, according to an embodiment of the invention. MIDI notes 855, 860, and 865 are configured in a chord configuration with slight offsets shown between each vertically adjacent note. Similarly, notes 870, 875, and 880 have more significant offsets between vertically adjacent notes. The small offsets between vertically adjacent notes are indicative of realistic sounding chords since a real player would be unlikely to hit each note at exactly the same time, or may intend to hit place small deltas between notes for certain stylistic preferences (e.g., arpeggiations).

Figure 8C:
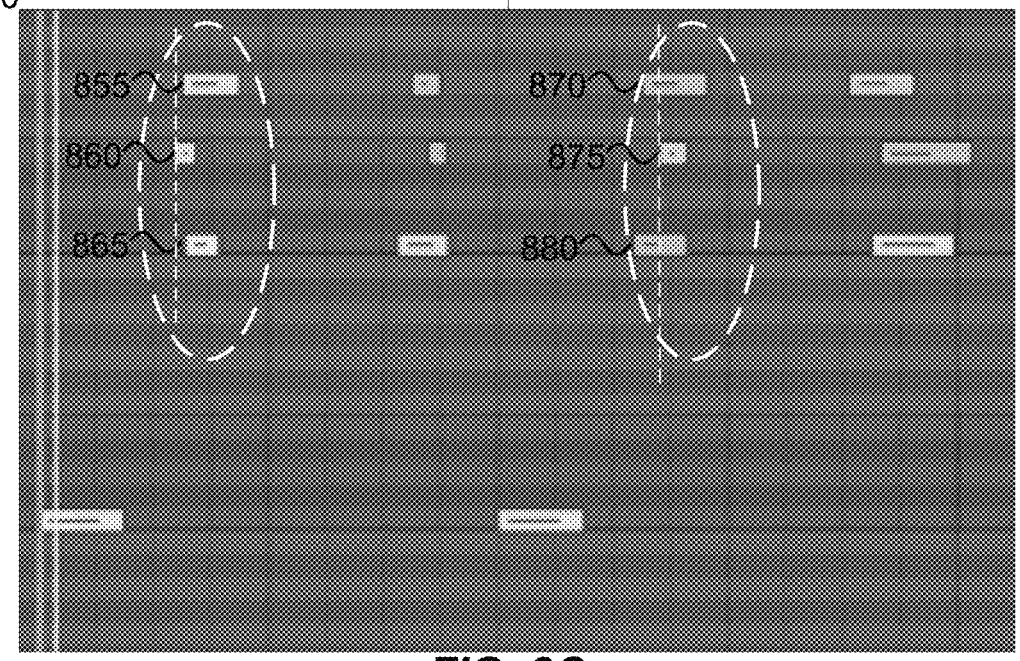
FIG. 8C illustrates a MIDI pattern 880 of arpeggiated chords after applying a continuous shuffle groove template, according to an embodiment of the invention.

FIG. 8C illustrates a MIDI pattern 880 of arpeggiated chords after applying a continuous shuffle groove template, according to an embodiment of the invention. As shown, applying an $8^{th}$ note swing continuous groove template to the chords of FIG. 8B collectively shifts the notes forward to create a shuffle feel, yet maintains the original relationship between the notes with respect to one another. For example, notes 855, 860, and 865 are shifted in a positive direction, yet their arpeggiated configuration is maintained. Similarly, notes 870, 875, and 880 are also shifted in a positive direction with their arpeggiated configuration maintained. Thus, a shuffle groove is applied to a series of notes and chords, while preserving the original feel of the performance for a realistic and authentic sounding swing groove.

As result, common drum articulations like flams, drags, and rolls are maintained when the groove template is applied. This also applies to chords where the notes are not played at exactly the same time, like on a piano or strumming a guitar (i.e., arpeggios). In some embodiments, it is also possible to have offsets that are larger than the grid or have in-between shift values. It should be noted that groove patterns are not limited to algorithmically created patterns and could be applied to any audio or MIDI-based event patterns. In further embodiments, input block 130 may include a user interface to visually display the offset line 815 and allow user interaction to edit, manipulate, and change characteristics of offset line 815, target positions, event (e.g., note) resolution (e.g., ⅛ notes, $1/16^{th}$ notes, etc.), and the like.

Figure 9:
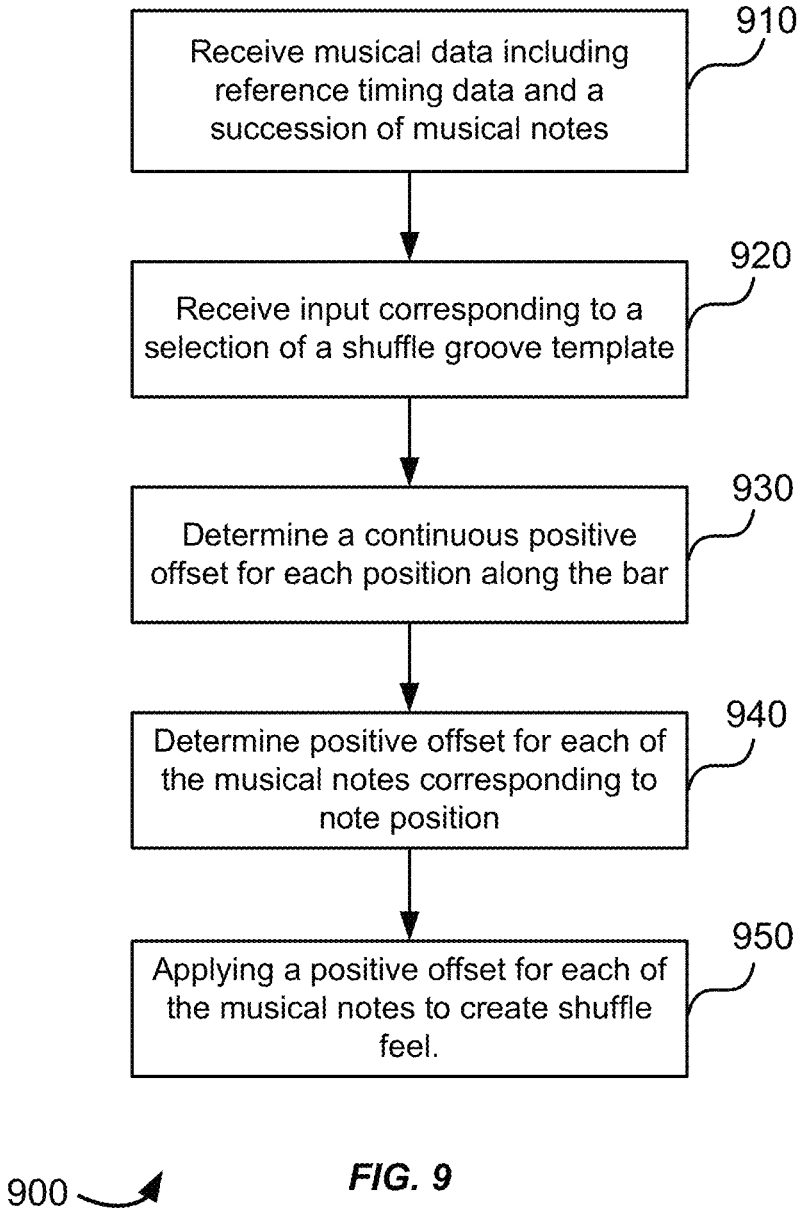
FIG. 9 is a simplified flow diagram illustrating aspects of a method of generating a shuffle groove for a musical accompaniment, according to an embodiment of the invention.

FIG. 9 is a simplified flow diagram illustrating aspects of a method 900 of generating a shuffle groove for a musical accompaniment, according to an embodiment of the invention. Method 900 can be performed by processing logic that may comprise hardware (e.g., circuitry, dedicate logic, etc.), software (which as is run on a general purpose computing system or a dedicated machine), firmware (embedded software), or any combination thereof. In one embodiment, method 900 is performed by system 100 of FIG. 1.

At 910, method 900 begins with receiving musical data including reference timing data and a succession of musical notes arranged with respect to the reference timing data. The reference timing data can include a plurality of positions forming a musical bar. In some embodiments, the succession of musical notes can be MIDI data arranged along the musical bar. At 920, system 100 receives input corresponding to a selection of a shuffle groove template. The shuffle groove template can be a selectable "personality" from a particular genre or subset thereof, as described above with respect to FIGS. 6A-6C. In certain embodiments, one particular personality may include shuffle-styled rhythms configured to automatically adapt the succession of musical notes into a shuffle-pattern. Optionally, the amount of shuffle applied to a given succession of musical notes is controlled by swing control 536.

At 930, system 100 determines a continuous positive offset for each position along the musical bar. The continuous positive offset can be represented by an offset line or continuous groove template defining an amount of positive shift to apply to a note or chord at each position along the bar relative to a series of predetermined target notes that define a shuffle pattern, as shown in FIG. 8A. System 100 then determines the position of each of the succession of musical notes along the musical bar. At 940, a positive offset is determined for each of the musical notes based on their relative position, and at 950, a positive offset is applied for each of the musical notes to create a shuffle feel. In certain embodiments, the continuous groove template has no breaks in continuity between each position of the musical bar or when looped with successive musical bars. As discussed above, some of the plurality of positions can include target positions, where the positive offset associated with each non-target position (i.e., the musical notes) includes a positive offset towards the next target position along the musical bar. In some aspects, the continuous groove template for the shuffle groove varies in offset between target positions wherein substantially no offset is associated with target positions, and where the offset increases in non-target positions located progressively farther from the next target position, as illustrated in FIG. 8A.

It should be appreciated that the specific steps illustrated in FIG. 9 provides a particular method 900 of generating a shuffle groove for a musical accompaniment, according to an embodiment of the present invention. Other sequences of steps may also be performed according to alternative embodiments. In certain embodiments, method 900 may perform the individual steps in a different order, at the same time, or any other sequence for a particular application. For example, alternative embodiments may utilize different target positions, different offsets at each position along the bar, or may utilize similar methods of using target positions and varying shifts along the musical bar when implementing other musical embellishments (e.g., micro-timing, micro-dynamics, etc.). Moreover, the individual steps illustrated in FIG. 9 may include multiple sub-steps that may be performed in various sequences as appropriate to the individual step. Furthermore, additional steps may be added or removed depending on the particular applications. One of ordinary skill in the art would recognize and appreciate many variations, modifications, and alternatives of the method.

Figure 10:
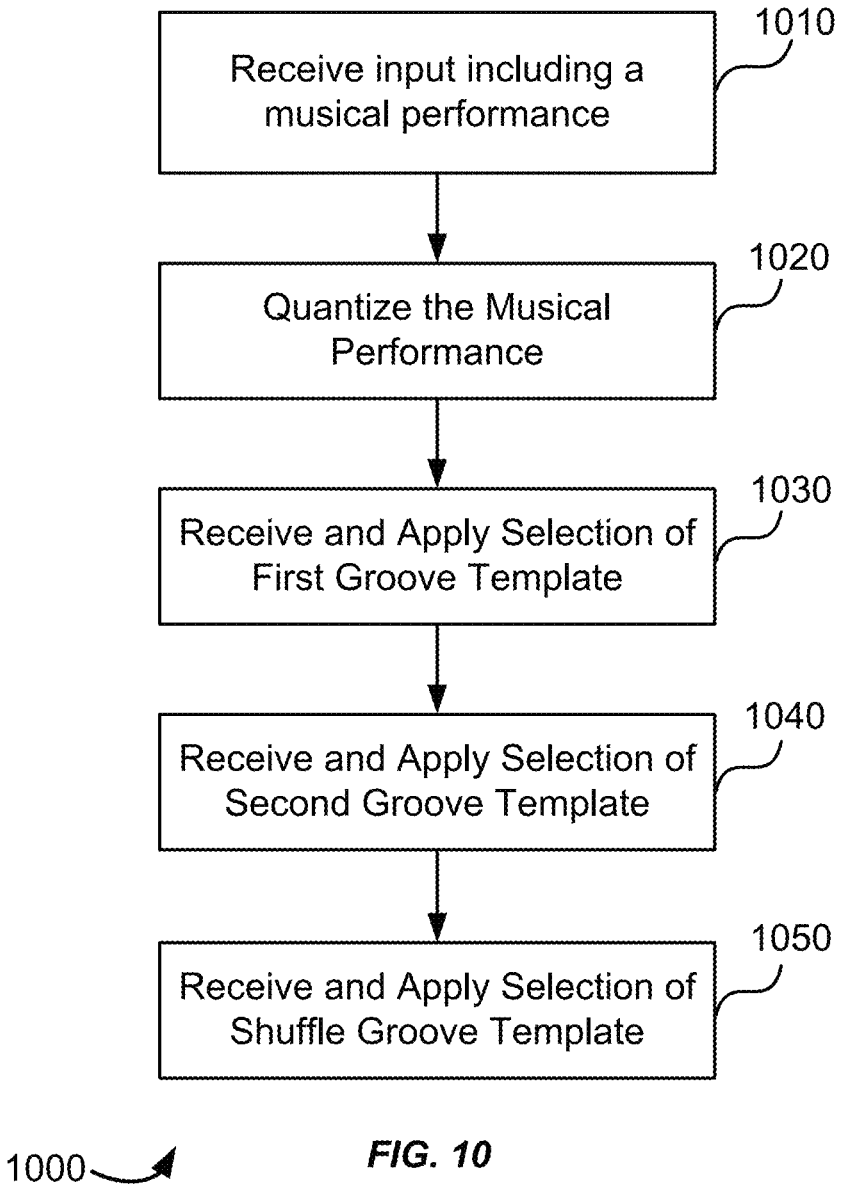
FIG. 10 is a simplified flow diagram illustrating aspects of a method of applying multiple layers of groove templates to a musical accompaniment, according to an embodiment of the invention.

FIG. 10 is a simplified flow diagram illustrating aspects of a method 1000 of applying multiple layers of groove templates to a musical accompaniment, according to an embodiment of the invention. Method 1000 can be performed by processing logic that may comprise hardware (e.g., circuitry, dedicate logic, etc.), software (which as is run on a general purpose computing system or a dedicated machine), firmware (embedded software), or any combination thereof. In one embodiment, method 1000 is performed by system 100 of FIG. 1.

At 1010, a musical performance is received. The musical performance can be a succession of musical notes or chords placed along a musical bar. The musical performance can be represented in any suitable format, including, but not limited to, MIDI sequences.

At 1020, method 1000 continues with quantizing a musical performance, according to an embodiment of the invention. In digital music processing technology, quantization is the process of transforming performed musical notes, which may have some imprecision due to expressive performance, to an underlying musical representation that eliminates this imprecision. The process can result in notes being set on beats and on exact fractions of beats. Thus, a sloppy or imprecise performance can be "corrected" by quantizing the notes and moving them to certain positions along the musical bar that make the performance sound "tighter" or more uniform in its precision. The process of quantization is well known and its application would be known and appreciated by one of ordinary skill in the art.

At 1030, a selection for a first groove template is received and applied to the musical performance, according to an embodiment of the invention. In some embodiments, the first groove template can include micro-timing changes to the musical performance such that certain musical elements fluctuate behind the beat. For example, a quantized kick-and-snare pattern may include snare notes placed precisely on the beat. In one aspect, the first groove template can move the snare notes to varying locations immediately after its quantized location to simulate a "looser" or more human performance. In another embodiment, the first groove template may cause both kick and snare notes to fluctuate before and after the beat (i.e., their quantized starting points) to also simulate a more human sounding performance.

At 1040, a selection for a second groove template is received and applied to the musical performance, according to an embodiment of the invention. In one embodiment, the second groove template can include changes in micro-dynamics to embellish the musical performance. For example, a particular groove template may incorporate additional snare notes in the form of double sticks, flams, and ghost notes throughout the performance. It should be noted that the different groove templates are independent of one another and the application of one groove template may not necessarily affect the placement or alteration of notes incorporated by another groove template. In this case, the musical performance was first quantized to align the notes of the musical performance into an exacting arrangement of notes. The first groove template added micro-timing changes to add an inexact or more realistic sounding element to the musical performance. Adding micro-dynamics (e.g., ghost notes) will not necessarily change the location of any of the existing notes in the musical performance, but merely add notes. However, if micro-dynamics were added to the musical performance first, followed by micro-timing changes, the placements of the added embellishments may be affected since the embellishments may be subject to micro-timing displacements.

At 1050, a selection for a shuffle groove template is received and applied to the musical performance, according to an embodiment of the invention. As described above with respect to FIG. 9, a shuffle feel can be systematically applied to a given musical performance by applying a continuous positive offset for each position along the musical bar of the musical performance. The continuous positive offset can be represented by an offset line or continuous groove template defining an amount of positive shift to apply to a note or chord at each position along the bar relative to a series of predetermined target notes that define a shuffle pattern, as shown by offset line 815 in FIG. 8A. The position of each of the succession of musical notes along the musical bar is determined and a positive offset is applied for each of the musical notes to create a shuffle feel. The continuous groove template typically has no breaks in continuity between each position of the musical bar or when looped end-to-end with successive musical bars. It should be noted that adding a continuous offset based shuffle to the musical performance will not necessarily affect or negate the effects of a previously implemented groove template, as conventional methods typically do. For example, as FIGS. 8B-8C clearly illustrate, any previously existing offsets between notes (e.g., chord arpeggiations, micro-timing differences, etc.) will retain their configuration with respect to each other as each note is individually shifted toward a target shuffle position based on its position along the bar. As such, realistic sounding rhythmic beats and accompaniments can be created using multiple groove templates, while retaining the individual characteristics of each.

It should be appreciated that the specific steps illustrated in FIG. 10 provides a particular method of generating a rhythmic accompaniment for a musical performance, according to an embodiment of the present invention. Other sequences of steps may also be performed according to alternative embodiments. In certain embodiments, method 1000 may perform the individual steps in a different order, at the same time, or any other sequence for a particular application. For example, some rhythmic accompaniments may not be quantized, or the various groove templates may be applied in a different order for different affects. Alternatively, a shuffle groove template may be added prior to adding additional groove templates. Furthermore, some groove templates can be configured to be unaffected by other groove templates. For example, a groove template including micro-dynamics can be selected to maintain the position of the additional notes (e.g., ghost notes, flams, etc.) after a shuffle groove is subsequently applied. That is, the shuffle groove may shift all of the notes in a musical bar except for notes added as micro-dynamics. Any suitable combination of groove templates and subsets thereof can be configured in any way as would be appreciated by one of ordinary skill in the art with the benefit of this disclosure. Moreover, the individual steps illustrated in FIG. 10 may include multiple sub-steps that may be performed in various sequences as appropriate to the individual step. Furthermore, additional steps may be added or removed depending on the particular applications. One of ordinary skill in the art would recognize and appreciate many variations, modifications, and alternatives of the method.

Arrangement Data

Figure 11:
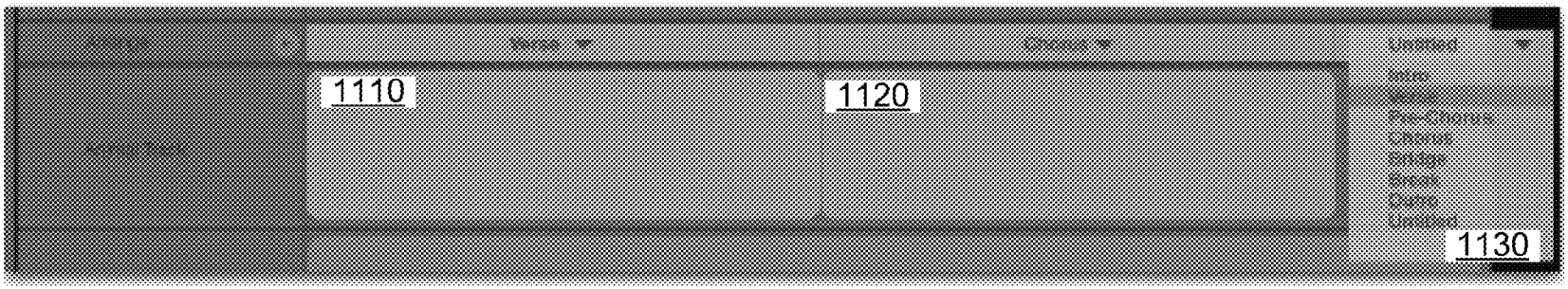
FIG. 11 illustrates a sample track of a musical performance separated by section, according to an embodiment of the invention.

FIG. 11 illustrates a sample track of a musical performance separated by section, according to an embodiment of the invention. A musical performance can be divided into a number of parts including an intro, verse, chorus, bridge, and the like. For example, the track (i.e., musical performance) shown in FIG. 11 includes a verse section 1110, a chorus section 1120, and a section assigner 1130. While arrangement data is not necessary to create a rhythm accompaniment, it can be used as an input value for filtering and modification rules. For example, by indicating that a certain portion of a musical performance is a chorus section, a livelier or catchier accompaniment may be generated, as opposed to a section identified as an intro. In certain embodiments, arrangement data can be used to apply preconfigured default templates for different song sections.

Performance Data

Performance data can be used as an input to generate a rhythmic accompaniment. One advantage of the present invention is the ability to receive a musical performance in a variety of formats, break it down to its elemental rhythmic components (i.e., accent pattern), and create a rhythmic accompaniment based on those elemental components, such that the rhythmic accompaniment sounds particularly well-matched as if it was created specifically for the particular musical performance. The musical performance can be a transient waveform (e.g., analog waveform), a MIDI sequence, or other format, as would be appreciated by one of ordinary skill in the art with the benefit of this disclosure.

Figure 12:
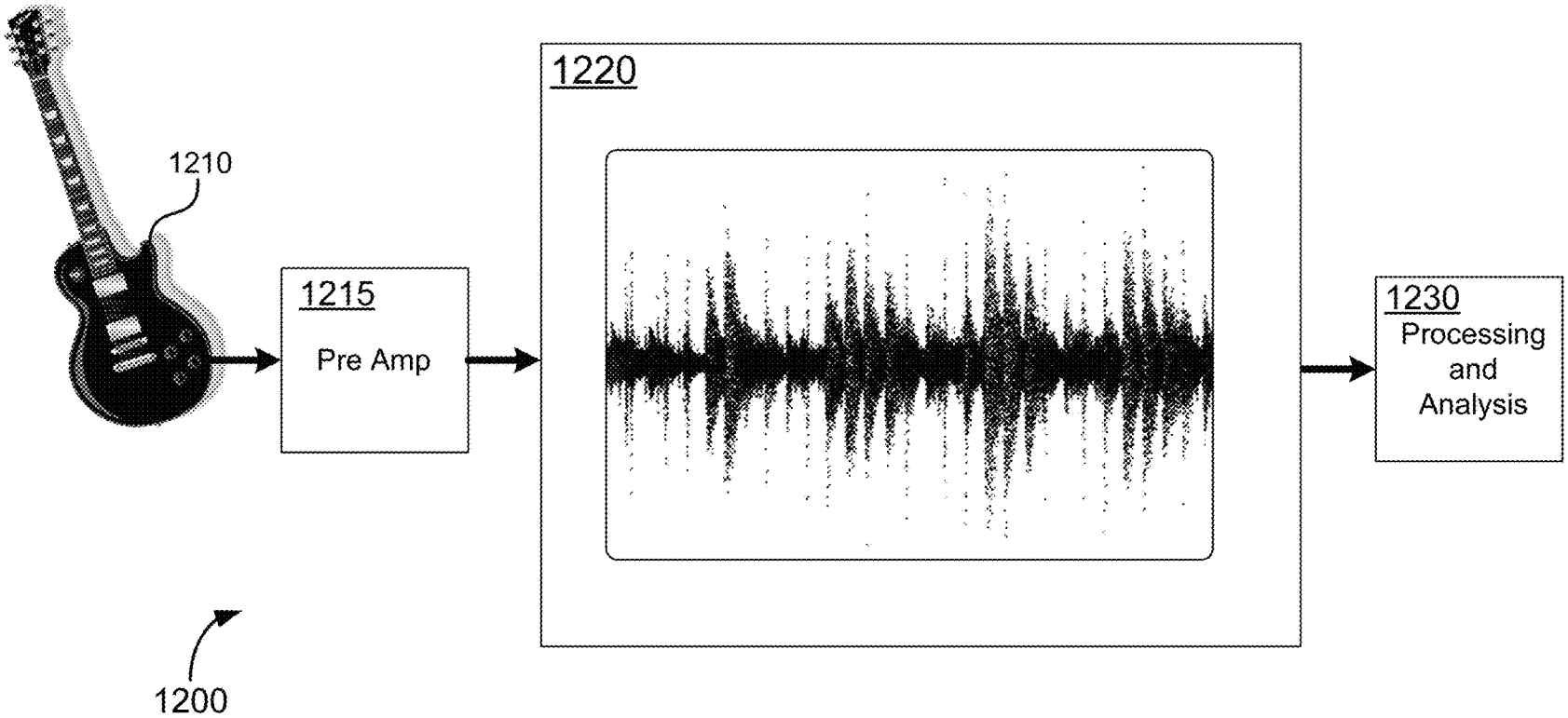
FIG. 12 is a simplified diagram illustrating the amplification and processing of an audio waveform, according to an embodiment of the invention.

FIG. 12 is a simplified diagram 1200 illustrating the amplification 115 and processing of an audio waveform 1220, according to an embodiment of the invention. Diagram 1200 includes an electric stringed instrument (e.g., electric guitar) 1210, a preamplifier (preamp) 1215, an audio waveform 1220, and a processing block 1230. The electric stringed instrument 1210 can be any suitable electric instrument (e.g., guitar, bass, violin, etc.) that can convert acoustical sound waves (e.g., vibrating strings) to an electrical signal. Alternatively, the electrical signal can be generated by a microphone recording any virtually any acoustic instrument (e.g., wood wind, brass, strings, or the like).

The output of instrument 1210 is coupled to preamp 1215 for amplification. A preamplifier (preamp) is an electronic amplifier that prepares a small electrical signal for further amplification or processing. It can be used to boost signal strength to higher levels without significantly degrading the signal-to-noise ratio (SNR). Some electrical audio signals may not require pre-amplification and thus a preamp stage 1215 is not required. The audio waveform 1220 is an analog waveform depicting a snapshot of the magnitude of the audio signal with respect to time. Audio waveforms 1220 can take a variety of shapes, patterns, and characteristics based on the type of signal detected. The various types of audio waveforms and their pertinent characteristics (e.g., frequency, amplitude, phase, etc.) would be understood by those of ordinary skill in the art.

Audio waveform 1220 is coupled to the processing and analysis block 1230. In certain embodiments, the processing and analysis block 1230 performs transient detection with digital signal processing to determine a basic accent pattern to base the rhythmic accompaniment on. In some embodiments, the signal processing can be performed by performance block 150 of system 100. Any suitable system block, processor, or the like, can be used to perform the signal processing described herein.

Figure 13:
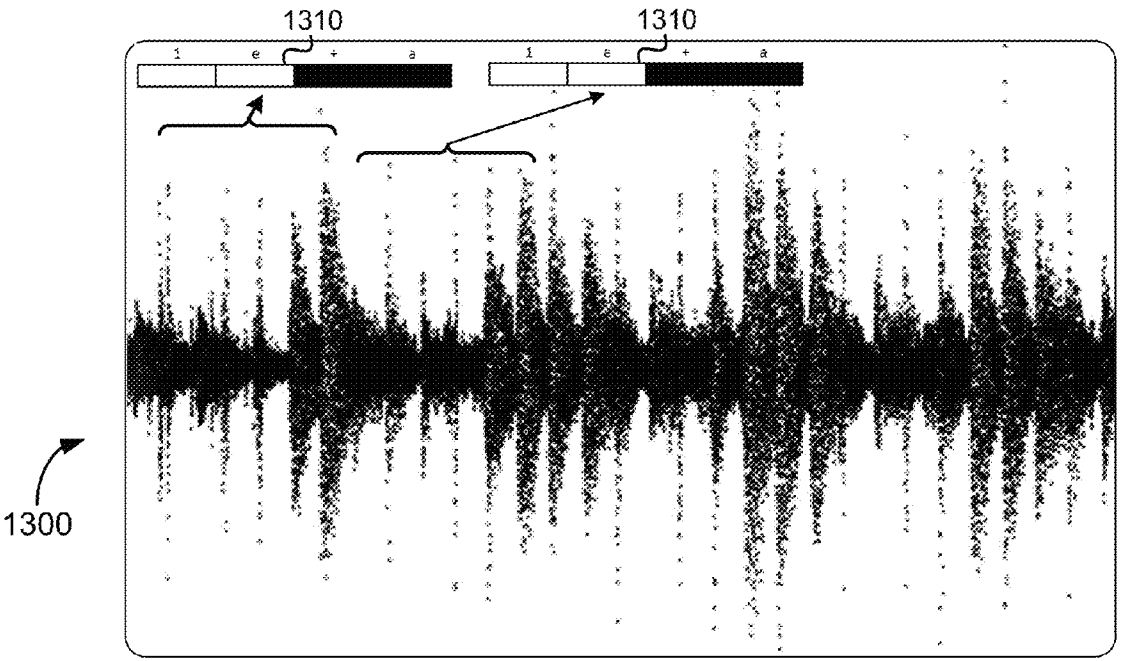
FIG. 13 illustrates an analysis of a musical performance to determine an accent pattern, according to an embodiment of the invention.

FIG. 13 illustrates an analysis of a musical performance 1300 to determine an accent pattern, according to an embodiment of the invention. The musical performance (i.e., audio waveform) 1300 includes a number of signal characteristics including audio peaks, patterns, frequency characteristics, phase characteristics, timing characteristics (e.g., tempo), and the like. These signal characteristics can be analyzed in a digital or analog domain to determine basic accent patterns that may repeat throughout musical performance. Musical performance 1300 can be performance data, audio data, audio waveform data, digital audio data, etc.

Referring to FIG. 13, accent pattern 1310 is determined based on the signal characteristics. Accent pattern 1310 is a repeating 4-bar pattern with accents on the last two beats. Any type of accent pattern is capable of being detected including 8-bar patterns, 16-bar patterns, or any other desired bar lengths. Once the accent pattern 1310 is determined, it is compared to a database library of reference accent patterns to determine a suitable accent pattern to base the rhythmic accompaniment, as discussed below.

Figure 14:
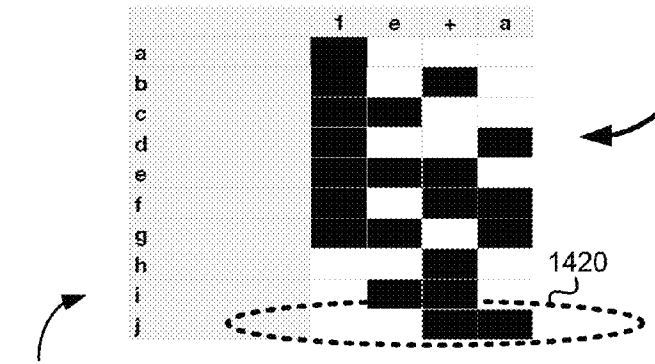
FIG. 14 illustrates aspects of accent pattern matching, according to an embodiment of the invention.

FIG. 14 illustrates aspects of accent pattern matching, according to an embodiment of the invention. In certain embodiments, accent pattern matching includes the process of receiving musical data (i.e., bass line, guitar riff, piano track, etc.), identifying a succession of accentuated events, and determining an accent pattern based thereon. The accent pattern is compared to a library or database of reference accent patterns and matched to one or more of the closest matching reference pattern. A reference accent pattern can then be selected and a rhythmic accompaniment is created that is based on the reference accent pattern. As a result, the rhythmic accompaniment will be well-matched to the musical data (i.e., musical performance). In some embodiments, the accent pattern can be determined in musical performance block 150 of system 100. Reference accent patterns can be stored and retrieved from accent pattern data database 126 of musical elements database 120, as shown in system 100 of FIG. 1.

Database 1400 depicts ten different 4-bar reference accent patterns labeled a-j, according to an embodiment of the invention. As described above, the accent pattern determined from the musical data (i.e., musical performance) is compared to the reference accent patterns to find the closest match. Using the accent pattern 1310 determined from FIG. 13, reference accent pattern 1420 is selected as a match. Selections can be made based on algorithmic analysis, probability and statistical analysis, rules or policy based section, or any suitable method and any combination thereof. Furthermore, any type of reference accent patterns (e.g., 4-bar, 8-bar, 16-bar patterns, odd number bar patterns, etc.) can be stored and referenced. In some implementations, multiple accent patterns may be derived from a musical performance. For example, a 4-bar accent pattern and an 8-bar accent pattern may be derived from the musical data of a musical performance. In some cases, FRD 160 can determine the best match based on characteristics of the accent pattern, as well as other input (e.g., input block 130) and arrangement parameters (e.g., arrangement block 140), as further described above.

Figure 15:
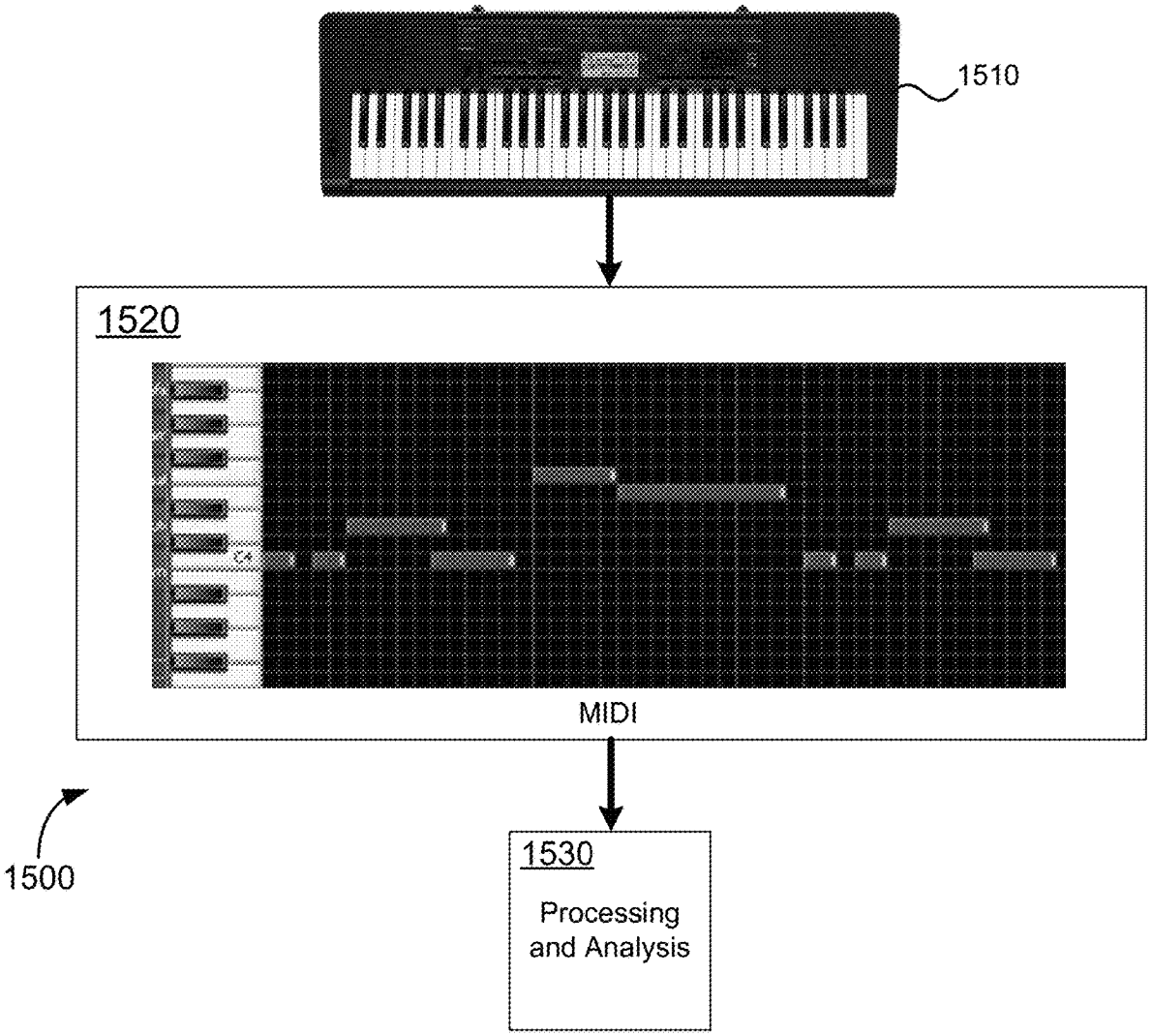
FIG. 15 is a simplified diagram illustrating the processing of a MIDI signal, according to an embodiment of the invention.

FIG. 15 is a simplified diagram 1500 illustrating the processing of a MIDI signal 1520, according to an embodiment of the invention. Diagram 1500 includes a MIDI instrument (e.g., keyboard) 1510, a MIDI-based pattern 1520, and a processing block 1530. The MIDI instrument 1510 can be any suitable MIDI device (e.g., synthesizer, virtual instrument, etc.) configured to generate MIDI patterns.

MIDI signal 1520 is coupled to the processing and analysis block 1530. In certain embodiments, the processing and analysis block 1530 determines an accent pattern of MIDI signal 1520. In some embodiments, the accent pattern analysis is performed by musical performance block 150 of system 100. Any suitable system block, processor, or the like, can be used to determine the accent pattern of MIDI signal 1520.

Figure 16:
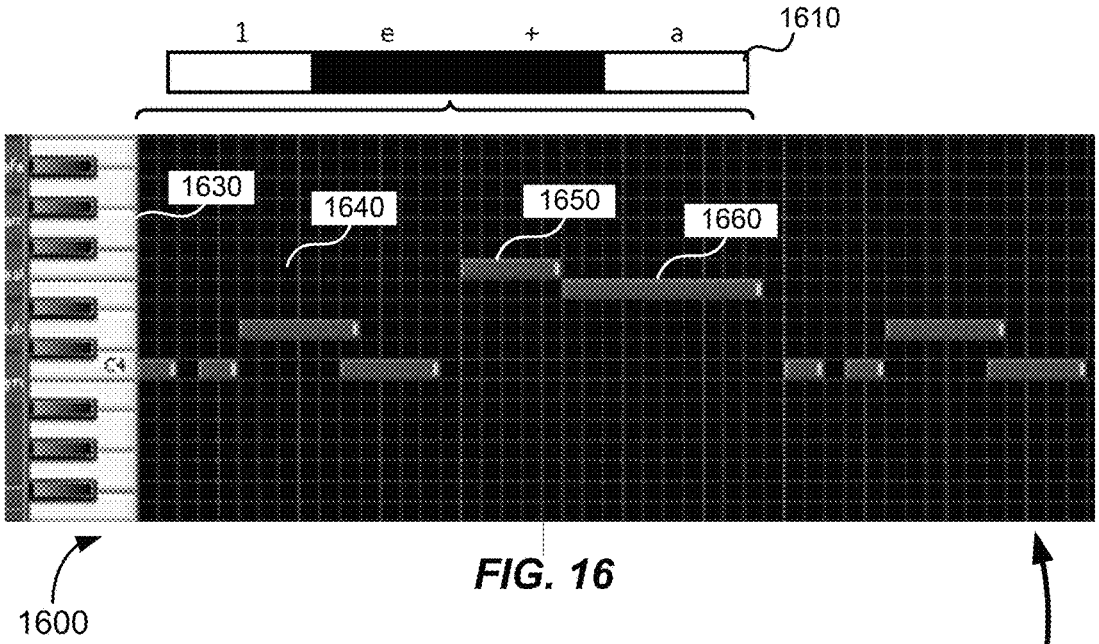
FIG. 16 illustrates an analysis of a musical performance to determine an accent pattern, according to an embodiment of the invention.

FIG. 16 illustrates an analysis of a musical performance 1600 to determine an accent pattern, according to an embodiment of the invention. Musical performance (i.e., MIDI signal) 1600 includes a digital piano roll 1630 including a plurality of playable notes with a sequencing track 1640 configured for each note. Musical performance 1600 includes a number of notes 1650, 1660 sequenced on a digital piano roll 1630.

Referring to FIG. 16, accent pattern 1610 is determined based on the MIDI pattern on piano roll 1630. In this example, accent pattern 1610 is determined to be a repeating 4-bar pattern with accents on the middle two beats. Any type of patterns are capable of being detected including 8-bar patterns, 16-bar patterns, or even patterns for non-traditional bar lengths. Once the accent pattern 1610 is determined, it is compared to a database library of reference accent patterns (e.g., reference accent patterns 126 of musical elements database 120) to determine a suitable accent pattern to base the rhythmic accompaniment.

Figure 17:
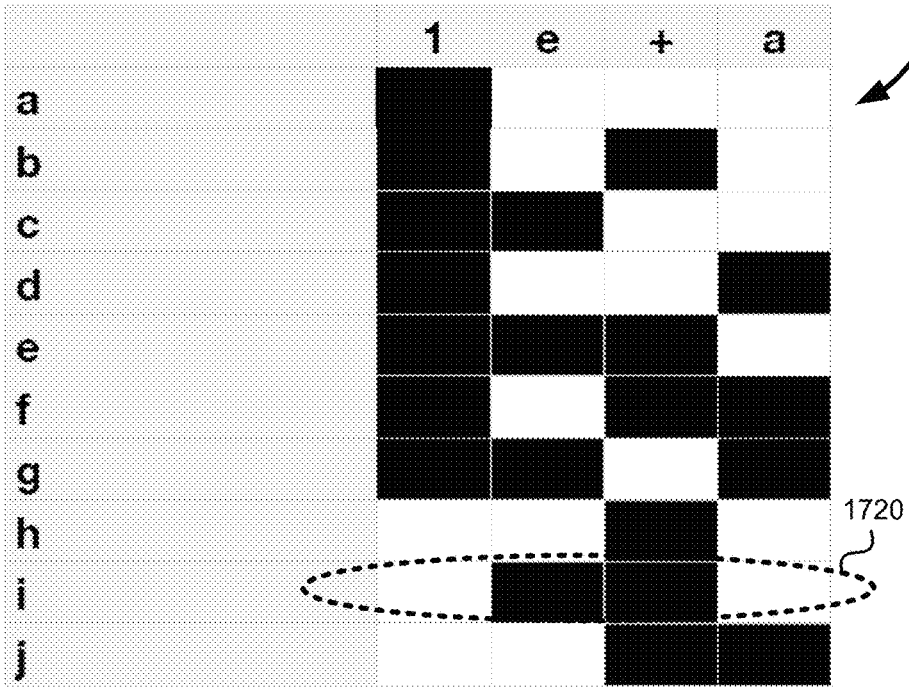
FIG. 17 illustrates aspects of accent pattern matching, according to an embodiment of the invention.

FIG. 17 illustrates aspects of accent pattern matching, according to an embodiment of the invention. In certain embodiments, accent pattern matching includes the process of receiving musical data (e.g., MIDI data), identifying a succession of accentuated events, and determining an accent pattern based thereon. The accent pattern is compared to a library or database of reference accent patterns and matched to one or more of the closest matching reference pattern. A reference accent pattern can then be selected and a rhythmic accompaniment is created that is based on the reference accent pattern. As a result, the rhythmic accompaniment will be well-matched to the musical data (i.e., musical performance). In some embodiments, the accent pattern can be determined in musical performance block 150 of system 100. Reference accent patterns can be stored and retrieved from accent pattern data database 126 of musical elements database 120, as shown in system 100 of FIG. 1.

Database 1700 depicts ten different 4-bar reference accent patterns labeled a-j, according to an embodiment of the invention. As described above, the accent pattern determined from the musical data (i.e., musical performance) is compared to the reference accent patterns to find the closest match. Using the accent pattern 1610 determined from FIG. 16, reference accent pattern 1720 is selected as a match. Selections can be made based on pattern matching, algorithmic analysis, probability and statistical analysis, rules or policy based selection, or any suitable method and any combination thereof. Any type of reference accent patterns (e.g., 4-bar, 8-bar, 16-bar patterns, odd number bar patterns, etc.) can be stored and referenced as required. Furthermore, multiple accent patterns may be derived from a musical performance. For example, a 4-bar accent pattern and an 8-bar accent pattern may be derived from the musical data of a musical performance. In some cases, FRD 160 can determine the best match based on characteristics of the accent pattern, as well as other input (e.g., input block 130) and arrangement parameters (e.g., arrangement block 140), as further described above.

Figure 18:
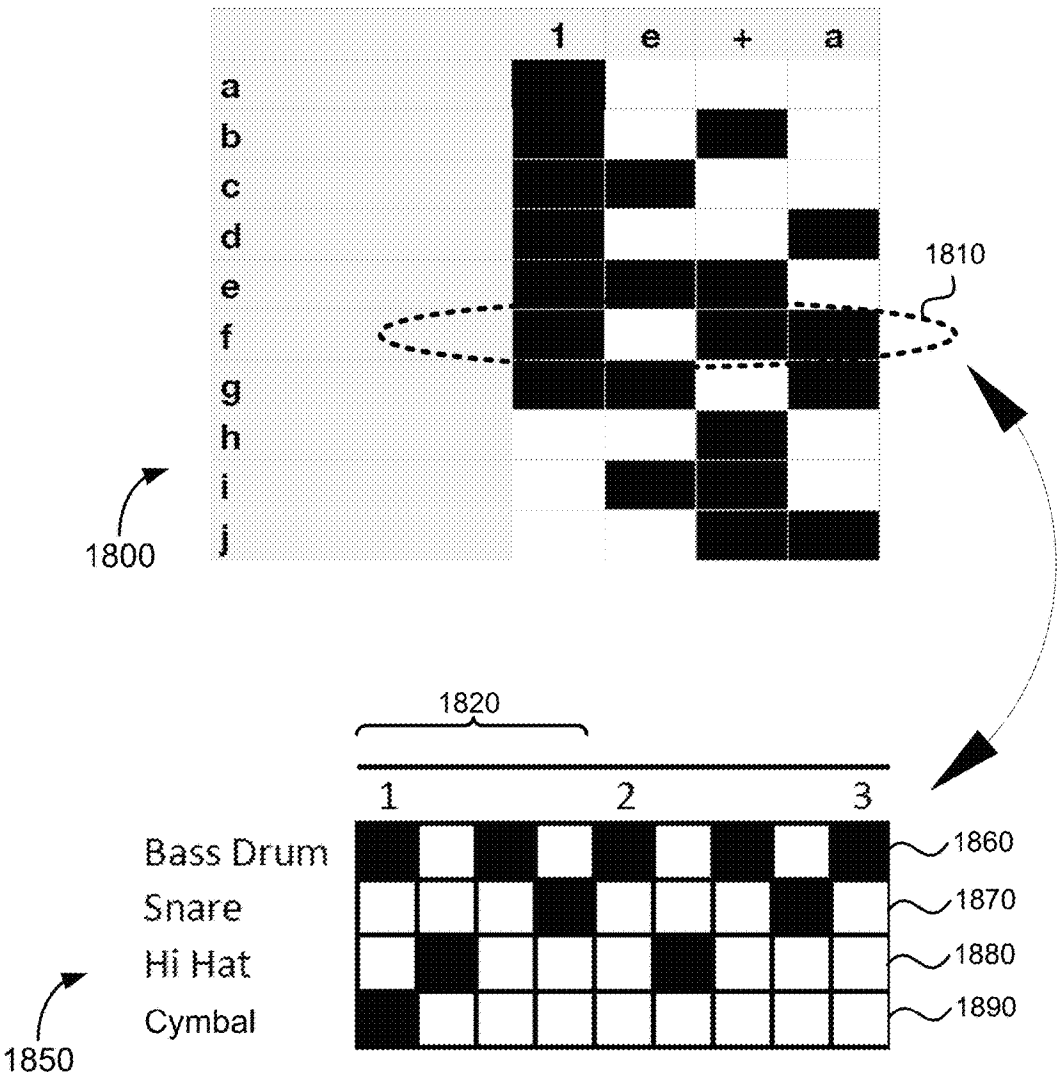
FIG. 18 illustrates the process of generating a rhythm accompaniment based on a reference accent pattern, according to an embodiment of the invention.

FIG. 18 illustrates the process of generating a rhythm accompaniment based on a reference accent pattern, according to an embodiment of the invention. Database 1800 depicts ten different 4-bar reference accent patterns labeled a-j, with reference accent pattern 1810 selected as a match to a given musical performance (not shown). In this example, reference accent pattern 1810 includes accents on the first, third, and fourth beats of a 4-bar rhythm.

A percussion based rhythmic accompaniment 1850 can be generated based on the selected reference accent pattern 1810. Rhythmic accompaniment 1850 includes a bass drum track 1860, a snare track 1870, and hi-hat track 1880, and a cymbal track 1890. In this particular arrangement, the bass drum and snare tracks are configured to track reference accent pattern 1810 with bass and/or snare notes on the first, third, and fourth beats, as shown in pattern 1820. Alternatively, the resulting accompaniment may not match the reference accent pattern and, in fact, may compliment or contrast the particular accent pattern of the musical performance. For example, a musical performance such as a bass line may be a complex accent pattern that a user may want in the forefront of a performance. The rhythmic accompaniment can be configured to highlight the intricacies of the bass line by creating a simple percussive accompaniment that does not detract from the bass performance. For example, the kick, snare, or crash cymbals can be configured to avoid certain notes of an accent pattern and maintain a subtle percussive backdrop. There are a myriad of ways that accent patterns can be used to create rhythmic accompaniments and playing accent patterns with a kick and snare combination is only one of many effective and musically pleasing methods. Although one particular accompaniment 1850 is shown, any number of styles, configurations, and arrangements of rhythmic accompaniments can be generated from a single reference pattern. In addition to a reference accent pattern, user inputs (e.g., groove templates), arrangement data, or other relevant data can be used to shape or influence the resulting rhythmic accompaniment. In some embodiments, depending on the complexity (e.g., see FIG. 5B), a generated pattern may consist of a subset of events found in a reference pattern, exactly match the events in the reference pattern, or even add events to those found in the reference pattern. It should be noted that "events" in a reference pattern can be notes, chords, or other musical element.

Figure 19:
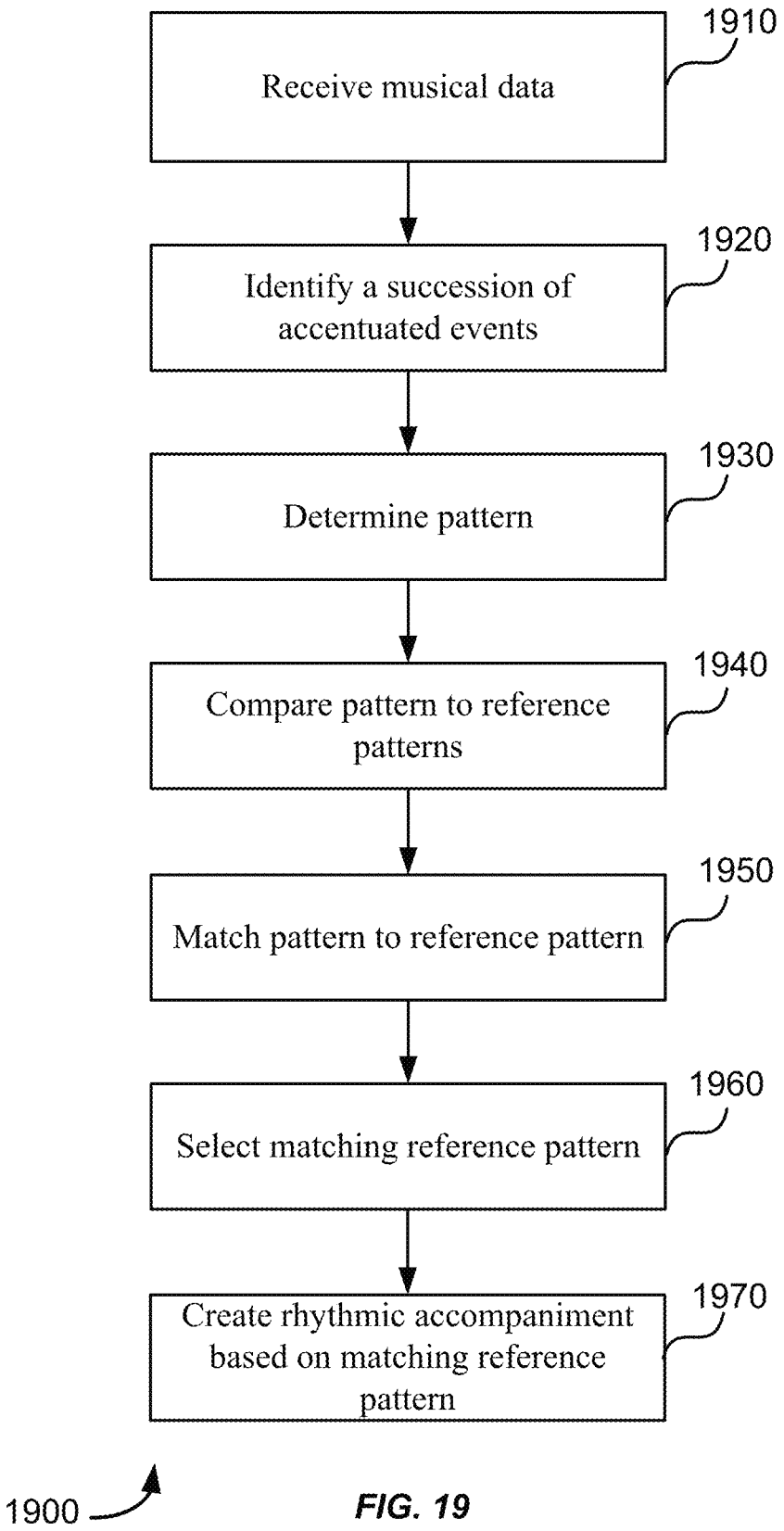
FIG. 19 is a simplified flow diagram illustrating aspects of a method of generating an accompaniment for a musical performance, according to an embodiment of the invention.

FIG. 19 is a simplified flow diagram illustrating aspects of a method 1900 of generating an accompaniment for a musical performance, according to an embodiment of the invention. Method 200 can be performed by processing logic that may comprise hardware (e.g., circuitry, dedicate logic, etc.), software (which as is run on a general purpose computing system or a dedicated machine), firmware (embedded software), or any combination thereof. In one embodiment, method 200 is performed by aspects of system 100 of FIG. 1 including musical performance block 150 and filter and rules database 160.

At 1910, method 1900 begins with receiving musical data, according to an embodiment of the invention. The musical data can be an analog or digitally based musical performance. Analog-based musical data typically includes an audio waveform featuring a number of signal characteristics including audio peaks, patterns, frequency characteristics, phase characteristics, timing characteristics (e.g., tempo), and the like, and may include any suitable instruments including acoustic instruments, electric instruments, or any musical tool that provides an electronic representation (e.g., audio waveform) of a musical performance. Digital data can include any suitable MIDI-based instrument or device configured to generate MIDI patterns. In some embodiments, the musical performance block 150 of system 100 receives the musical data.

At 1920, a succession of accentuated events is identified in the musical data, according to an embodiment of the invention. In certain aspects, musical data can be analyzed to identify accentuated events and non-accentuated events. Accentuated events can be determined for analog-based musical data (e.g., waveforms) by analog or digital signal processing by analyzing its signal characteristics (e.g., audio peaks, patterns, frequency/phase characteristics, tempo, etc.). Accent patterns can be determine for digitally-based musical data (e.g., MIDI data) by analyzing the velocity of MIDI note events, note pitch, note placement or position, note duration, chord progressions, etc., as would be appreciated by one of ordinary skill in the art with the benefit of this disclosure. In some embodiments, the musical performance block 150 of system 100 can identify a succession of accentuated events in the musical data.

At 1930, the succession of accentuated events is analyzed and an accent pattern is determined, according to an embodiment of the invention. As previously described, the accent pattern is a fundamental beat and can be used to create a rhythmic accompaniment. At 1940, the accent pattern is compared to one or more accent reference patterns to find a match or substantially matching pattern. Matching can be based on note placement comparison, algorithmic analysis, probability and statistical analysis, rules or policy based selections, or any suitable method and any combination thereof. In certain embodiments, accent reference patterns can be stored in a database (e.g., accents database 126 of musical elements database 120) for retrieval and analysis. At 1950, the accent pattern is matched to one or more reference accent patterns, and a matching accent reference pattern is selected (1960). At 1970, a rhythmic accompaniment is created based, in part, on the selected reference accent pattern. In some cases, the rhythmic accompaniment may include a constantly changing reference accent pattern to reflect possible user edits performed on any track(s) being followed including changes to genre, arrangements, drummer selections, user guided performance parameters (e.g., complexity, fills, etc.), and the like.

It should be appreciated that the specific steps illustrated in FIG. 19 provides a particular method of generating a rhythmic accompaniment for a musical performance, according to an embodiment of the present invention. Other sequences of steps may also be performed according to alternative embodiments. In certain embodiments, method 2000 may perform the individual steps in a different order, at the same time, or any other sequence for a particular application. Moreover, the individual steps illustrated in FIG. 19 may include multiple sub-steps that may be performed in various sequences as appropriate to the individual step. Furthermore, additional steps may be added or removed depending on the particular applications. One of ordinary skill in the art would recognize and appreciate many variations, modifications, and alternatives of the method.

Figure 20:
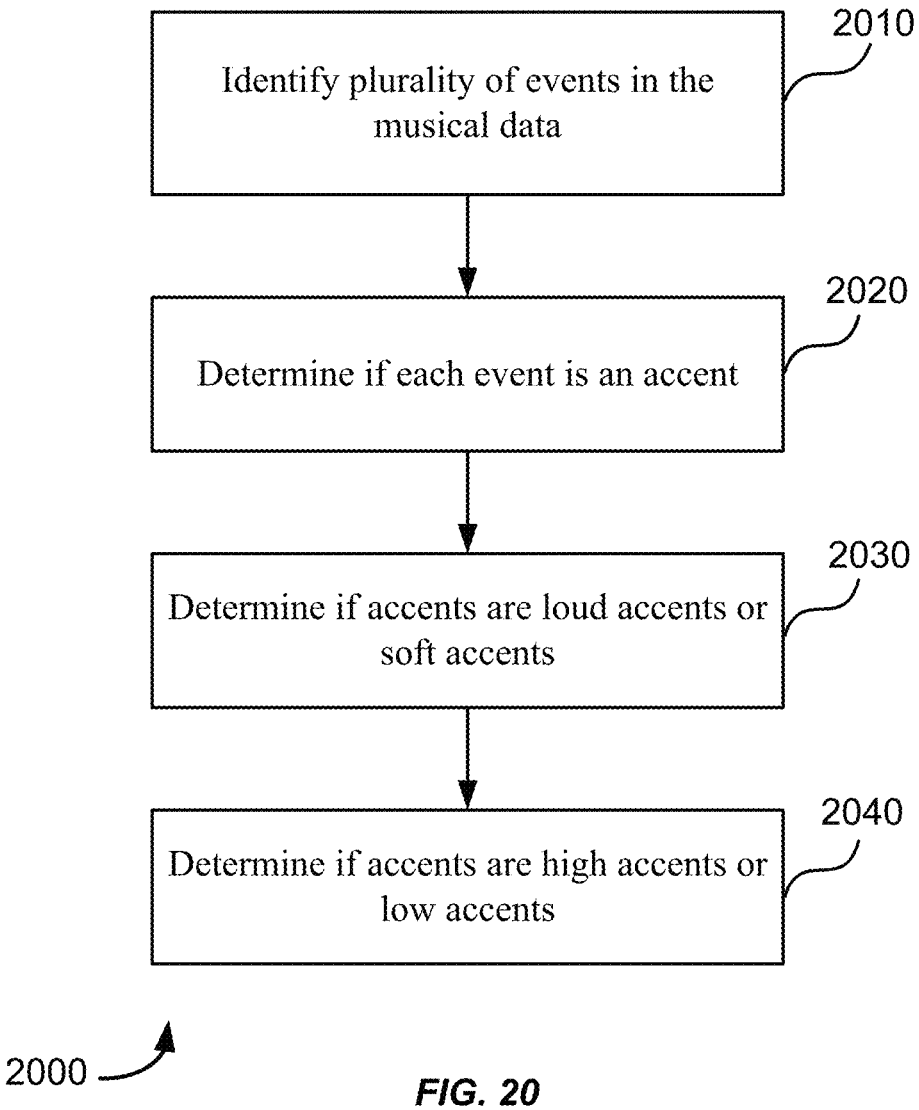
FIG. 20 is a simplified flow diagram illustrating aspects of a method of identifying a plurality of events in musical data, according to an embodiment of the invention.

FIG. 20 is a simplified flow diagram illustrating aspects of a method 200 of identifying a plurality of events in musical data, according to an embodiment of the invention. Method 2000 can be performed by processing logic that may comprise hardware (e.g., circuitry, dedicate logic, etc.), software (which as is run on a general purpose computing system or a dedicated machine), firmware (embedded software), or any combination thereof. In one embodiment, method 2000 can be performed by system 100 of FIG. 1.

At 2010, method 2000 begins with identifying a plurality of events in musical data. Events can include accents or non-accent characteristics. At 2020, each event is evaluated to determine if it is an accent. As discussed above, accent patterns can be used to identify the basic rhythmic characteristics of a musical performance (i.e., musical data), such that a suitable rhythmic accompaniment can be created that matches musical performance. This is typically a binary consideration, however accents can be further characterized into a number of categories, which may be helpful in "fine tuning" or tailoring the generated rhythmic accompaniment to the musical performance. In some cases, accents may be loud or soft (e.g., amplitude), as determined at 2030, while others may be high pitched or low pitched (e.g., frequency), as determined at 2040. For example, musical data from a musical performance may have several basic accent patterns (a 4-bar accent pattern and an 8-bar accent pattern) that significantly differ, but each could be used to generate a rhythmic accompaniment. In another example, determining an accent may be based on a prominent pitch among a series of lower or higher pitches. In some cases, the amplitude and frequency of the accents can be considered to identify the better suited accent pattern for a particular musical performance, as would be appreciated by one of ordinary skill in the art with the benefit of this disclosure. Other methods of determining accent patterns may be based on note or event characteristics including note prominence (i.e., volume, velocity, pitch, etc.), event length, tonal characteristics/color, timbre, the signal envelope of the musical performance or a part thereof, arrangement attack, or other suitable event characteristic.

It should be appreciated that the specific steps illustrated in FIG. 20 provides a particular method of generating a rhythmic accompaniment for a musical performance, according to an embodiment of the present invention. Other sequences of steps may also be performed according to alternative embodiments. In certain embodiments, method 2000 may perform the individual steps in a different order, at the same time, or any other sequence for a particular application. Moreover, the individual steps illustrated in FIG. 20 may include multiple sub-steps that may be performed in various sequences as appropriate to the individual step. Furthermore, additional steps may be added or removed depending on the particular applications. One of ordinary skill in the art would recognize and appreciate many variations, modifications, and alternatives of the method.

Filtering Rules and Modifications

As described above, pattern generation can be a modular framework with some custom made modules and script language that can filter, combine and modify patterns, based on the various input parameters described above. For example, certain patterns (e.g., accent patterns, system patterns, etc.) are sent through different modules that modify the "probability" of the selection of each pattern. In some cases, modules that modify probability may be drummer styles (see FIG. 6A-6C). For modifying patterns, events can be selected based on any criteria such as velocity, position in musical bar, kit piece, etc., and any desired action can be implemented (e.g., deletion, modification, etc.). In summary, the filtering process is highly flexible with tools to author a large number of rules to algorithmically create musical content. In some embodiments, patterns of events (e.g., reference accent patterns, reference system patterns, etc.) can be stored in musical elements database 120. In some cases, filtering, combining and modifying patterns, and the various modules described herein can be performed by filtering block 160.

Modules can be manually authored rules relating to the name and content of a particular pattern, or tables can be used that, for example, define how well specific pattern combinations work together either serially (relating to the previous pattern) or in parallel (e.g., relating to other parts like accents, fills, reference accent pattern, etc.). In some cases, additional to the filtering rules, certain events (e.g., notes, chords, etc.) can be added, deleted, or moved, their velocities or articulations can be changed, etc. Furthermore, some modules can define an interaction between different parts of the performance (e.g., systems reacting to accents), and apply timing and dynamics of the groove template patterns.

In certain implementations, each pattern (e.g., reference pattern) or a subset thereof in the musical elements database can be assigned a value or probability (e.g., ranging from 0 to 100). Different filters can be used to change this value and the pattern with the highest probability is more likely selected. Depending on the character and the selected variation, a number of patterns can be excluded by setting their probability to 0. Tables can also be used to decrease a probability of certain patterns based on factors including elements that are currently being played, elements played in the previous bar, or external parameters (e.g., song tempo, etc.). For example, if a fast rock pattern is currently being played, the probability of an R&B pattern being played next may be low. For the remaining patterns, their complexity can be calculated and their probabilities modified based on the current value of the complexity parameter.

In some embodiments, events can be added or removed based on filtering rules, probabilities, modules, or combinations thereof. For example, ghost notes on a snare can be added based on certain rules that may indicate that ghost notes can be added where snare events are not already placed, some ghost notes can be transformed into short rolls, or the amount of ghost notes and rolls may be determined by the chosen complexity and tempo, with fewer ghost notes and rolls at higher tempi and more ghost notes and rolls and lower tempi. In another example, snare backbeat strokes can be transformed to a flam (e.g., adding another stroke right before it) in case other parts of the patterns are muted, and a drummer would have had his second hand free. In yet another example, syncopated snare notes may be deleted in a pattern if the intensity is below a certain threshold where the snare switches to a cross stick articulation if the syncopation pattern would not be realistically playable anymore. As such, rhythmic accompaniments can include generated patterns and modifications that are based on what a real drummer would be able to do for added realism. In some situations, there may be filtering rule conflicts. For example, a certain accent pattern may be included with a particular system pattern. In situations where a drummer could not realistically play the system pattern with two hands and maintain the accents, the accent pattern can be permitted because the accent overrides the system pattern. Alternative rules may apply and a user can define musical element hierarchies and rules in any desired configuration.

Although the examples herein include snare placement and some embellishments, any kit piece (e.g., kick drum, tom, hi-hat, etc.) can be manipulated, modified, and applicable per certain rules to better simulate a realistic accompaniment. Also, these concepts also apply more broadly to rhythmic accompaniment generation across all instruments (e.g., guitar, bass, piano, etc.). For example, a pattern on the lower guitar register may be less likely to incorporate phrasing that utilizes notes on the highest frets. These rules and modifications would be understood and actionable by one of ordinary skill in the art with the benefit of this disclosure.

In further embodiments, event articulations, velocities, and kit pieces can be modified. For example, entire patterns or subsets thereof can be moved to a different kit piece. In some cases, articulations can be changes based on a selected intensity. For example, depending on the intensity, snare strokes may be changed from cross stick to normal strokes to rim shots. The velocity of events in a musical bar can be changed based on their position in the bar and the value of the selected intensity. In another example, the opening of a hi-hat (i.e., samples related to the open hi-hat) can change based on the intensity level. These are just a few of the rules and parameters that can be used filter, modify, and alter characteristics of event patterns, particular sounds (e.g., hi-hat characteristics), and the like, and many more rules and modifications would be understood and actionable by one of ordinary skill in the art with the benefit of this disclosure. In alternative embodiments, rhythmic accompaniment generation can be an iterative learning and adaptive process. For example, after frequent use, certain patterns, preferences, and settings can be analyzed by elements of system 100 to determine rhythmic accompaniments that are more likely to suit a particular user's preferences. For instance, a user may typically like more complex rhythms laden with many micro-dynamics. Subsequent rhythmic accompaniments may reflect this preference as a default setting.

System Architecture

Figure 21:
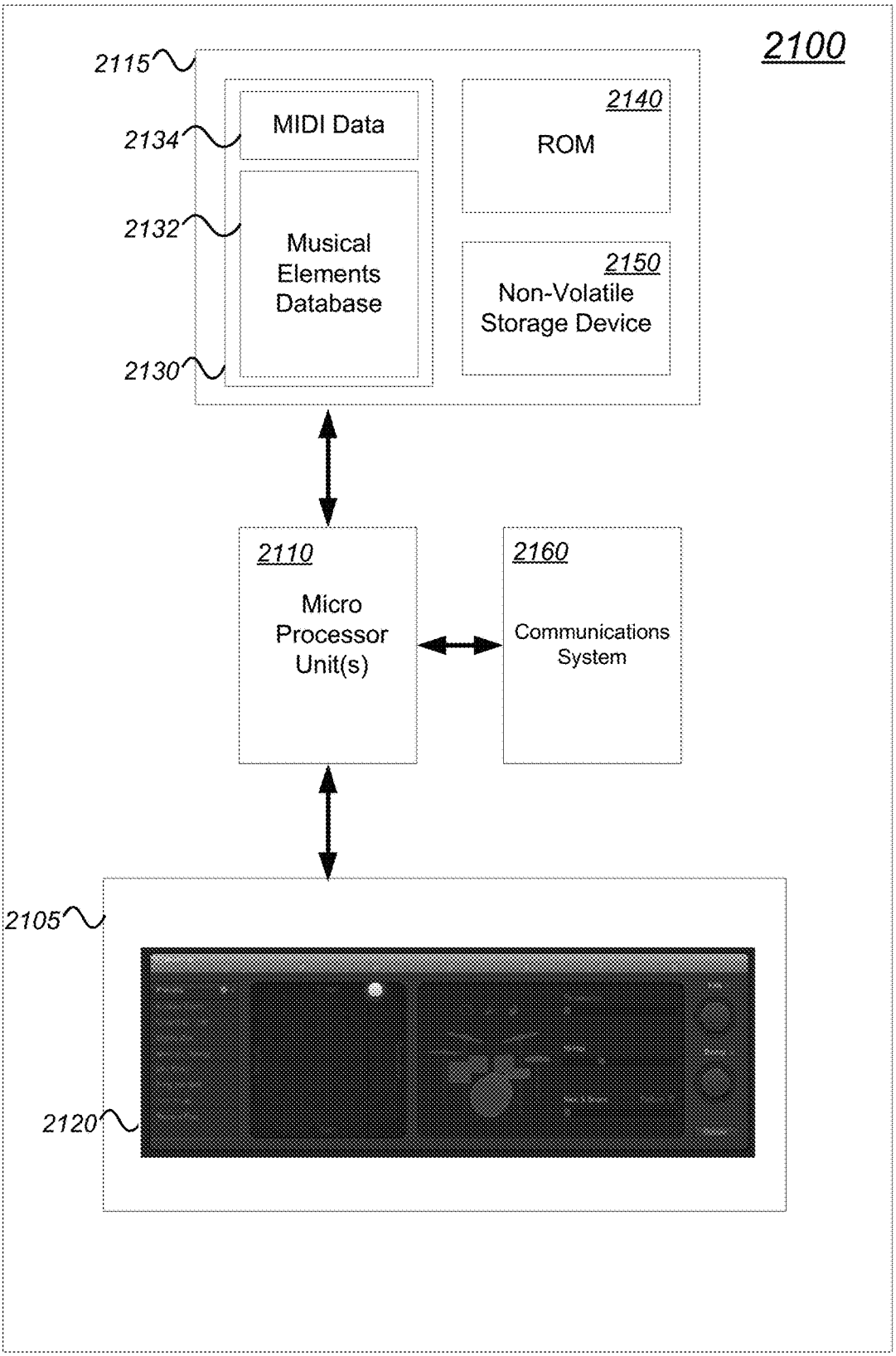
FIG. 21 illustrates an example of a system that can enable a user to generate a rhythmic accompaniment for a musical performance, according to an embodiment of the invention.

FIG. 21 illustrates an example of a system 2100 that can enable a user to generate a rhythmic accompaniment for a musical performance, according to an embodiment of the invention. System 2100 can be a device that can include multiple subsystems such as a display subsystem 2105, one or more processors or processing units 2110, a storage subsystem 2115, and a communications system 2160. One or more communication paths can be provided to enable one or more of the subsystems to communicate with and exchange data with one another. The various subsystems in FIG. 21 can be implemented in software, hardware, firmware, or combinations thereof. In some embodiments, the software can be stored on a transitory or non-transitory computer readable storage medium and can be executed by one or more processing units. In certain embodiments, storage subsystem 2115 comprises one or more memories for storing the data used or generated by certain embodiments of the present invention and for storing software (e.g., code, computer instructions) that may be executed by one or more processing units 2110.

It should be appreciated that system 2100 as shown in FIG. 21 can include more or fewer components than those shown in FIG. 21, can combine two or more components, or can have a different configuration or arrangement of components. In some embodiments, system 2100 can be a part of a portable computing device, such as a tablet computer, a mobile telephone, a smart phone, a desktop computer, a laptop computer, a kiosk, etc. The system 2100 can operate on an iPhone®, iPad®, iMac®, or the like.

In some embodiments, display subsystem 2105 can provide an interface that allows a user to interact with system 2100. The display subsystem 2105 may be a cathode ray tube (CRT), a flat-panel device such as a liquid crystal display (LCD), a projection device, a touch screen, or the like. In general, use of the term "output device" is intended to include all possible types of devices and mechanisms for outputting information from system 2100. For example, a software keyboard may be displayed using a flat-panel screen. In some embodiments, the display subsystem 2105 can be a touch interface, where the display provides both an interface for outputting information to a user of the device and also as an interface for receiving inputs. In other embodiments, there may be separate input and output subsystems. Through the display subsystem 2105, the user can view and interact with a GUI (Graphical User Interface) 2120 of a system 2100. In some implementations, the GUI shown can include elements from user input block 130, musical arrangement block 140, and/or musical performance block 150. In some embodiments, display subsystem 2105 can include a touch-sensitive interface (also sometimes referred to as a touch screen) that can both display information to the user and receive inputs from the user. Processing unit(s) 2110 can include one or more processors, each having one or more cores. In some embodiments, processing unit(s) 2110 can execute instructions stored in storage subsystem 2115. System 2100 can further include an audio system to play music (e.g., accompaniments, musical performances, etc.) through one or more audio speakers (not shown).

Communications system 2160 can include various hardware, firmware, and software components to enable electronic communication between multiple computing devices. Communications system 2160 or components thereof can communicate with other devices via Wi-Fi, Bluetooth, infrared, or any other suitable communications protocol that can provide sufficiently fast and reliable data rates to support the real-time jam session functionality described herein.

Storage subsystem 2115 can include various memory units such as a system memory 2130, a read-only memory (ROM) 2140, and a non-volatile storage device 2150. The system memory can be a read-and-write memory device or a volatile read-and-write memory, such as dynamic random access memory. System memory 2130 can store some or all of the instructions and data that the processor(s) or processing unit(s) need at runtime. ROM 2140 can store static data and instructions that are used by processing unit(s) 2110 and other modules of system 2100. Non-volatile storage device 2150 can be a read-and-write capable memory device. Embodiments of the invention can use a mass-storage device (such as a magnetic or optical disk or flash memory) as a permanent storage device. Other embodiments can use a removable storage device (e.g., a floppy disk, a flash drive) as a non-volatile (e.g., permanent) storage device.

Storage subsystem 2115 can store MIDI (Musical Instrument Digital Interface) data relating to accompaniments played on virtual instruments of system 2100 in MIDI database 2134. A musical elements database 2132 can store music elements such as a library of micro-timing data, micro-dynamics data, systems data, accents data, fills, and other musical elements. Storage subsystem 115 may also store audio recording data, and general song data (e.g., with track and instrument data). For MIDI-based tracks, MIDI data may be stored. Similarly, for audio-based tracks, audio data can be stored (e.g., audio files such as .wav, .mp3, and the like). Further detail regarding system architecture and the auxiliary components thereof (e.g., input/output controllers, memory controllers, etc.) are not discussed in detail so as not to obfuscate the focus on the invention and would be understood by those of ordinary skill in the art. In certain embodiments, system 2100 can incorporate system 100 therein.

Figure 22:
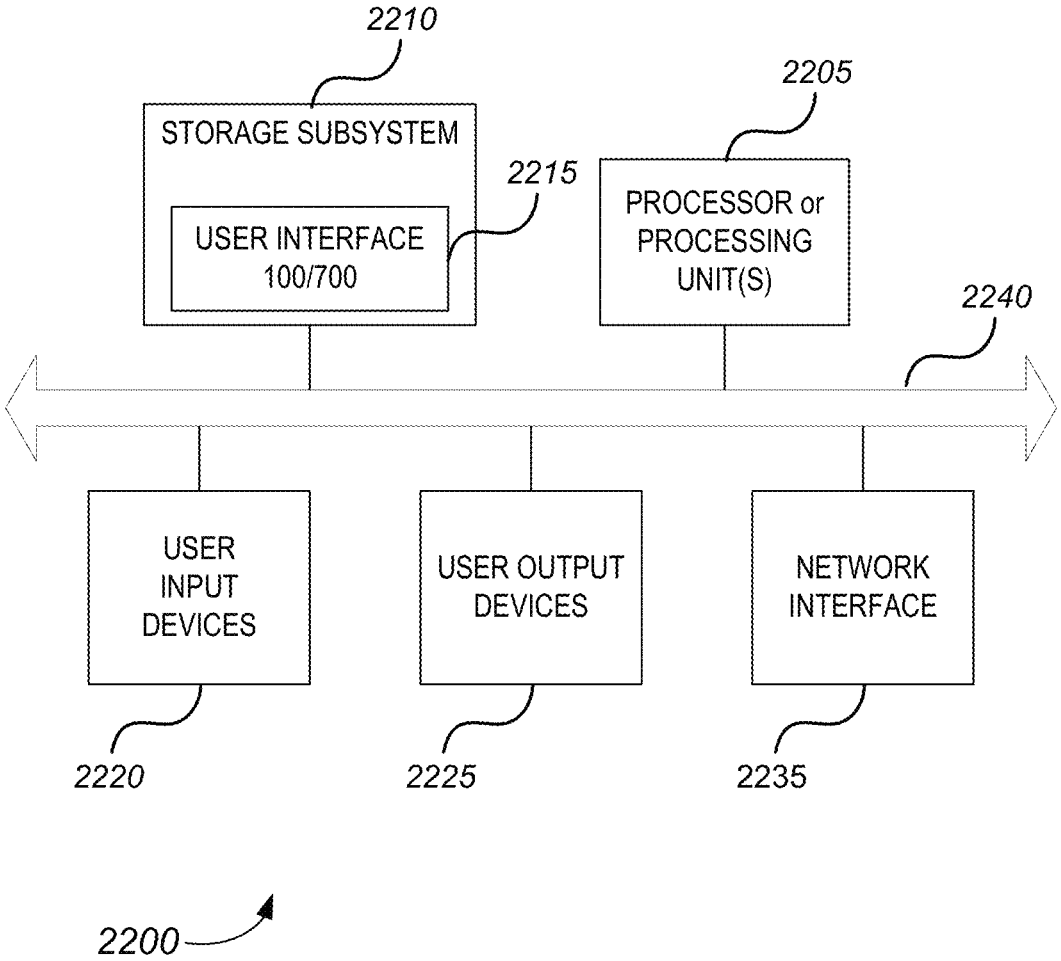
FIG. 22 illustrates a computer system, according to an embodiment of the present invention.

FIG. 22 illustrates a computer system 2200 according to an embodiment of the present invention. The user interfaces described herein (e.g., user input block 130) can be implemented within a computer system such as computer system 2200 shown here. Computer system 2200 can be implemented as any of various computing devices, including, e.g., a desktop or laptop computer, tablet computer, smart phone, personal data assistant (PDA), or any other type of computing device, not limited to any particular form factor. Computer system 2200 can include processing unit(s) 2205, storage subsystem 2210, input devices 2220, output devices 2225, network interface 2235, and bus 2240. In some embodiments, system 2200, system 100, other suitable systems or a combination thereof, can be operated in within the framework of Garageband® or Logic®, developed by Apple Computer®.

Processing unit(s) 2205 can include a single processor, which can have one or more cores, or multiple processors. In some embodiments, processing unit(s) 2205 can include a general purpose primary processor as well as one or more special purpose co-processors such as graphics processors, digital signal processors, or the like. In some embodiments, some or all processing units 2205 can be implemented using customized circuits, such as application specific integrated circuits (ASICs) or field programmable gate arrays (FPGAs). In some embodiments, such integrated circuits execute instructions that are stored on the circuit itself. In other embodiments, processing unit(s) 2205 can execute instructions stored in storage subsystem 2210.

Storage subsystem 2210 can include various memory units such as a system memory, a read-only memory (ROM), and a permanent storage device. The ROM can store static data and instructions that are needed by processing unit(s) 2205 and other modules of electronic device 2200. The permanent storage device can be a read-and-write memory device. This permanent storage device can be a non-volatile memory unit that stores instructions and data even when computer system 2200 is powered down. Some embodiments of the invention can use a mass-storage device (such as a magnetic or optical disk or flash memory) as a permanent storage device. Other embodiments can use a removable storage device (e.g., a floppy disk, a flash drive) as a permanent storage device. The system memory can be a read-and-write memory device or a volatile read-and-write memory, such as dynamic random access memory. The system memory can store some or all of the instructions and data that the processor needs at runtime.

Storage subsystem 2210 can include any combination of computer readable storage media including semiconductor memory chips of various types (DRAM, SRAM, SDRAM, flash memory, programmable read-only memory) and so on. Magnetic and/or optical disks can also be used. In some embodiments, storage subsystem 2210 can include removable storage media that can be readable and/or writeable; examples of such media include compact disc (CD), read-only digital versatile disc (e.g., DVD-ROM, dual-layer DVD-ROM), read-only and recordable Blue-Ray® disks, ultra density optical disks, flash memory cards (e.g., SD cards, mini-SD cards, micro-SD cards, etc.), magnetic "floppy" disks, and so on. The computer readable storage media do not include carrier waves and transitory electronic signals passing wirelessly or over wired connections.

In some embodiments, storage subsystem 2210 can store one or more software programs to be executed by processing unit(s) 2205, such as a user interface 2215. As mentioned, "software" can refer to sequences of instructions that, when executed by processing unit(s) 2205 cause computer system 2200 to perform various operations, thus defining one or more specific machine implementations that execute and perform the operations of the software programs. The instructions can be stored as firmware residing in read-only memory and/or applications stored in magnetic storage that can be read into memory for processing by a processor. Software can be implemented as a single program or a collection of separate programs or program modules that interact as desired. Programs and/or data can be stored in non-volatile storage and copied in whole or in part to volatile working memory during program execution. From storage subsystem 2210, processing unit(s) 2205 can retrieve program instructions to execute and data to process in order to execute various operations described herein.

A user interface can be provided by one or more user input devices 2220, display device 2225, and/or and one or more other user output devices (not shown). Input devices 2220 can include any device via which a user can provide signals to computing system 2200; computing system 2200 can interpret the signals as indicative of particular user requests or information. In various embodiments, input devices 2220 can include any or all of a keyboard touch pad, touch screen, mouse or other pointing device, scroll wheel, click wheel, dial, button, switch, keypad, microphone, and so on.

Output devices 2225 can display images generated by electronic device 2200. Output devices 2225 can include various image generation technologies, e.g., a cathode ray tube (CRT), liquid crystal display (LCD), light-emitting diode (LED) including organic light-emitting diodes (OLED), projection system, or the like, together with supporting electronics (e.g., digital-to-analog or analog-to-digital converters, signal processors, or the like), indicator lights, speakers, tactile "display" devices, headphone jacks, printers, and so on. Some embodiments can include a device such as a touchscreen that function as both input and output device.

In some embodiments, output device 2225 can provide a graphical user interface, in which visible image elements in certain areas of output device 2225 are defined as active elements or control elements that the user selects using user input devices 2220. For example, the user can manipulate a user input device to position an on-screen cursor or pointer over the control element, then click a button to indicate the selection. Alternatively, the user can touch the control element (e.g., with a finger or stylus) on a touchscreen device. In some embodiments, the user can speak one or more words associated with the control element (the word can be, e.g., a label on the element or a function associated with the element). In some embodiments, user gestures on a touch-sensitive device can be recognized and interpreted as input commands; these gestures can be but need not be associated with any particular array in output device 2225. Other user interfaces can also be implemented.

Network interface 2235 can provide voice and/or data communication capability for electronic device 2200. In some embodiments, network interface 2235 can include radio frequency (RF) transceiver components for accessing wireless voice and/or data networks (e.g., using cellular telephone technology, advanced data network technology such as 3G, 4G or EDGE, WiFi (IEEE 802.11 family standards, or other mobile communication technologies, or any combination thereof), GPS receiver components, and/or other components. In some embodiments, network interface 2235 can provide wired network connectivity (e.g., Ethernet) in addition to or instead of a wireless interface. Network interface 2235 can be implemented using a combination of hardware (e.g., antennas, modulators/demodulators, encoders/decoders, and other analog and/or digital signal processing circuits) and software components.

Bus 2240 can include various system, peripheral, and chipset buses that communicatively connect the numerous internal devices of electronic device 2200. For example, bus 2240 can communicatively couple processing unit(s) 2205 with storage subsystem 2210. Bus 2240 also connects to input devices 2220 and display 2225. Bus 2240 also couples electronic device 2200 to a network through network interface 2235. In this manner, electronic device 2200 can be a part of a network of multiple computer systems (e.g., a local area network (LAN), a wide area network (WAN), an Intranet, or a network of networks, such as the Internet. Any or all components of electronic device 2200 can be used in conjunction with the invention.

Some embodiments include electronic components, such as microprocessors, storage and memory that store computer program instructions in a computer readable storage medium. Many of the features described in this specification can be implemented as processes that are specified as a set of program instructions encoded on a computer readable storage medium. When these program instructions are executed by one or more processing units, they cause the processing unit(s) to perform various operation indicated in the program instructions. Examples of program instructions or computer code include machine code, such as is produced by a compiler, and files including higher-level code that are executed by a computer, an electronic component, or a microprocessor using an interpreter.

It will be appreciated that computer system 2200 is illustrative and that variations and modifications are possible. Computer system 2200 can have other capabilities not specifically described here (e.g., mobile phone, global positioning system (GPS), power management, one or more cameras, various connection ports for connecting external devices or accessories, etc.). Further, while computer system 2200 is described with reference to particular blocks, it is to be understood that these blocks are defined for convenience of description and are not intended to imply a particular physical arrangement of component parts. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Embodiments of the present invention can be realized in a variety of apparatus including electronic devices implemented using any combination of circuitry and software.

While the invention has been described with respect to specific embodiments, one skilled in the art will recognize that numerous modifications are possible including the displayed representation of the user interface 130 and the configuration of the various elements therein, such as their position, organization, and function, filtering rules and analysis, etc. Thus, although the invention has been described with respect to specific embodiments, it will be appreciated that the invention is intended to cover all modifications and equivalents within the scope of the following claims. In some embodiments, system 100 can be implemented wholly or in part by system 2200.

Figure 23:
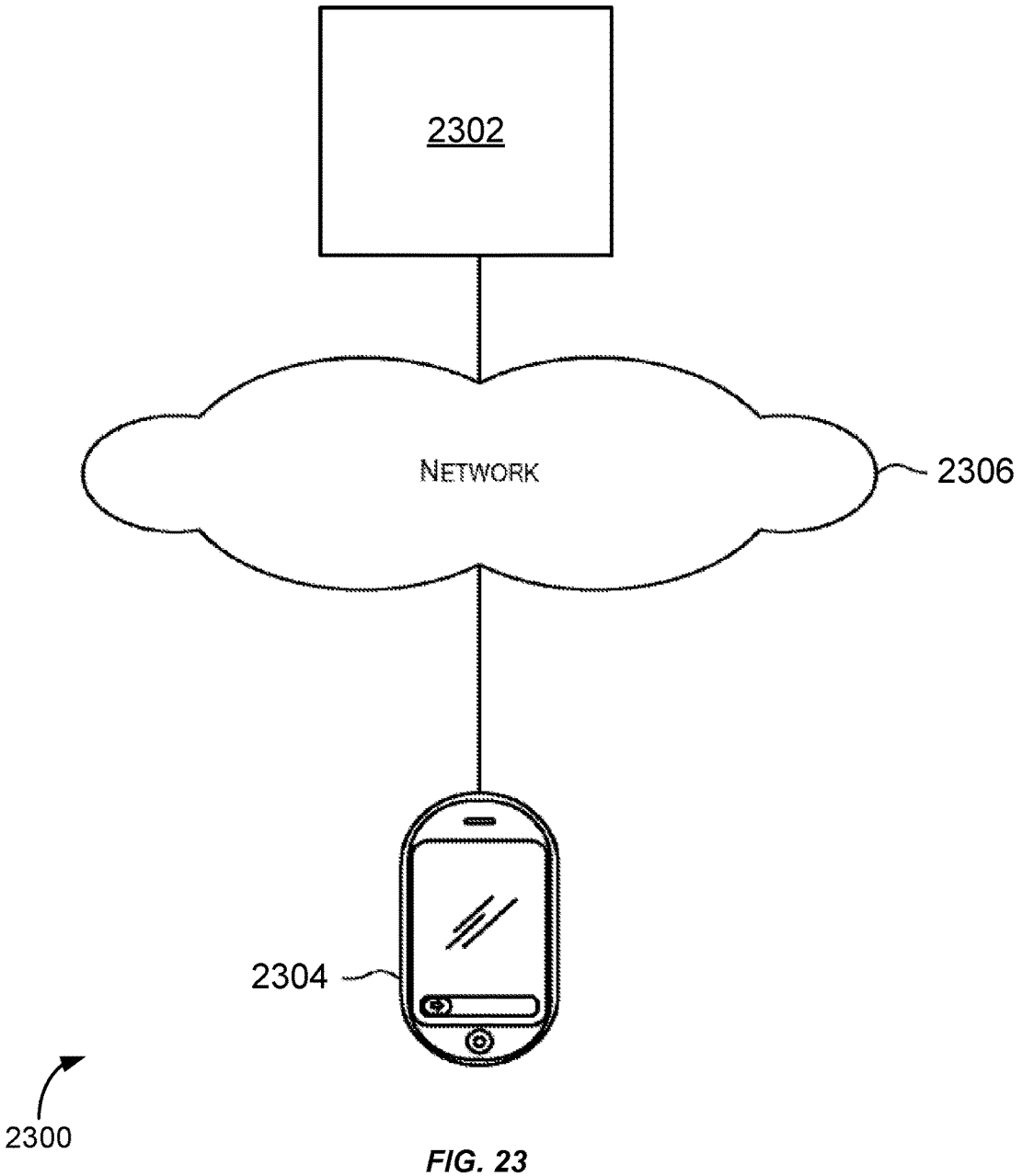
FIG. 23 depicts a simplified diagram of a distributed system for providing a system and method for generating a rhythmic accompaniment, according to certain embodiments of the invention.

System 100 depicted in FIG. 1 may be provided in various configurations. In some embodiments, system 100 may be configured as a distributed system where one or more components of system 100 are distributed across one or more networks in the cloud. FIG. 23 depicts a simplified diagram of a distributed system 2300 for providing a system and method for generating a rhythmic accompaniment according to some embodiments, according to an embodiment of the invention. In the embodiment depicted in FIG. 23, system 100 is provided on a server 2302 that is communicatively coupled with a remote client device 2304 via network 2306.

Network 1306 may include one or more communication networks, which could be the Internet, a local area network (LAN), a wide area network (WAN), a wireless or wired network, an Intranet, a private network, a public network, a switched network, or any other suitable communication network. Network 2306 may include many interconnected systems and communication links including but not restricted to hardwire links, optical links, satellite or other wireless communications links, wave propagation links, or any other ways for communication of information. Various communication protocols may be used to facilitate communication of information via network 2306, including but not restricted to TCP/IP, HTTP protocols, extensible markup language (XML), wireless application protocol (WAP), protocols under development by industry standard organizations, vendor-specific protocols, customized protocols, and others. In the configuration depicted in FIG. 23, aspects of system 100 may be displayed by client device 2304.

In the configuration depicted in FIG. 23, system 100 is remotely located from client device 2304. In some embodiments, server 2302 may perform the accompaniment generation functions described herein. In some embodiments, the services provided by server 2302 may be offered as web-based or cloud services or under a Software as a Service (SaaS) model.

It should be appreciated that various different distributed system configurations are possible, which may be different from distributed system 2300 depicted in FIG. 23. The embodiment shown in FIG. 23 is thus only one example of generating a rhythm accompaniment and is not intended to be limiting.

While the invention has been described with respect to specific embodiments, one skilled in the art will recognize that numerous modifications are possible. Thus, although the invention has been described with respect to specific embodiments, it will be appreciated that the invention is intended to cover all modifications and equivalents within the scope of the following claims.

The above disclosure provides examples and aspects relating to various embodiments within the scope of claims, appended hereto or later added in accordance with applicable law. However, these examples are not limiting as to how any disclosed aspect may be implemented, All the features disclosed in this specification (including any accompanying claims, abstract, and drawings) can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, sixth paragraph. In particular, the use of "step of" in the claims herein is not intended to invoke the provisions of 35 U.S.C. §112, sixth paragraph.

What is claimed is:

1. A computer-implemented method comprising:
storing musical elements in a database, the musical elements including a plurality of reference accent pattern data;
processing performance data including:
receiving input data corresponding to a musical performance;
determining an accent pattern for the musical performance;
matching the accent pattern data to one or more reference accent pattern data in the database; and
selecting one of the matching reference accent patterns; and
generating a musical accompaniment using the processed performance data, wherein the musical accompaniment includes a plurality of musical elements configured in a predetermined sequence.

2. The method of claim 1 further comprising:
receiving input corresponding to:
a selection of a musical style; and
one or more musical performance parameters,
wherein generating a musical accompaniment further includes the selected musical style, and the selected one or more musical performance parameters.

3. The method of claim 2 wherein the musical performance parameters includes one or more of:
intensity;
complexity;
swing; and
focus.

4. The method of claim 2 further comprising:
processing musical arrangement data including markers indicating:
a track; and
one or more of a verse, chorus, bridge, break, into, or outro, wherein generating the musical accompaniment is further based on the musical arrangement data.

5. The method of claim 2 wherein the musical accompaniment is a percussion-based musical accompaniment.

6. The method of claim 1 wherein the database further includes:
fills data;
micro-timing data; and
micro-dynamics data.

7. The method of claim 6 wherein each of the plurality of musical elements are arranged with respect to a time-based reference, and wherein the micro-timing data includes instructions indicating time-shifting one or more musical elements with respect to the time-based reference.

8. A computer-implemented system, comprising:
one or more processors;
one or more non-transitory computer-readable storage mediums containing instructions configured to cause the one or more processors to perform operations including:
storing musical elements in a database, the musical elements including a plurality of reference accent pattern data;
processing performance data including:
receiving input data corresponding to a musical performance;
determining an accent pattern for the musical performance;
matching the accent pattern data to one or more reference accent pattern data in the database; and
selecting one of the matching reference accent patterns; and
generating a musical accompaniment using the processed performance data, wherein the musical accompaniment includes a plurality of musical elements configured in a predetermined sequence.

9. The system of claim 8 further comprising instructions configured to cause the one or more processors to perform operations including:
receiving input corresponding to:
a selection of a musical style; and
one or more musical performance parameters,
wherein generating a musical accompaniment further includes the selected musical style, and the selected one or more musical performance parameters.

10. The system of claim 9 wherein the musical performance parameters includes one or more of:
intensity;
complexity;
swing; and
groove.

11. The system of claim 9 further comprising instructions configured to cause the one or more processors to perform operations including:
processing musical arrangement data including markers indicating:
a track; and
one or more of a verse, chorus, bridge, break, into, or outro, wherein generating the musical accompaniment is further based on the musical arrangement data.

12. The system of claim 9 wherein the musical accompaniment is a percussion-based musical accompaniment.

13. The system of claim 8 wherein the database further includes:
fills data;
micro-timing data; and
micro-dynamics data.

14. The system of claim 13 wherein each of the plurality of musical elements are arranged with respect to a time-based reference, and wherein the micro-timing data includes instructions indicating time-shifting one or more musical elements with respect to the time-based reference.

15. A computer program product stored on a non-transitory computer-readable storage medium comprising computer-executable instructions causing a processor to:
store musical elements in a database, the musical elements including a plurality of reference accent pattern data process performance data including:
receiving input data corresponding to a musical performance;
determining an accent pattern for the musical performance;
matching the accent pattern data to one or more reference accent pattern data in the database; and
selecting one of the matching reference accent patterns; and
generate a musical accompaniment using the processed performance data wherein the musical accompaniment includes a plurality of musical elements configured in a predetermined sequence.

16. The computer program product of claim 15 further comprising computer-executable instructions causing the processor to:
receive input corresponding to:
a selection of a musical style; and
one or more musical performance parameters, wherein generating a musical accompaniment further includes the selected musical style, and the selected one or more musical performance parameters.

17. The computer program product of claim 16 wherein the musical performance parameters includes one or more of:

intensity;

complexity;

swing; and groove.

18. The computer program product of claim 16 further comprising computer-executable instructions causing the processor to:

process musical arrangement data including markers indicating:

a track; and one or more of a verse, chorus, bridge, break, into, or outro, wherein generating the musical accompaniment is further based on the musical arrangement data.

19. The computer program product of claim 16 wherein the musical accompaniment is a percussion-based musical accompaniment.

20. The computer program product of claim 15 wherein the database further includes:

fills data;

micro-timing data; and micro-dynamics data.

21. The system of claim 20 wherein each of the plurality of musical elements are arranged with respect to a time-based reference, and wherein the micro-timing data includes instructions indicating time-shifting one or more musical elements with respect to the time-based reference.

* * * * *